US010036969B2

(12) United States Patent
Miyamoto et al.

(10) Patent No.: US 10,036,969 B2
(45) Date of Patent: Jul. 31, 2018

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Masahiko Miyamoto, Kangawa (JP); Daisuke Haruyama, Kanagawa (JP); Shigeto Hashiba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/447,290

(22) Filed: Mar. 2, 2017

(65) Prior Publication Data

US 2018/0031984 A1 Feb. 1, 2018

(30) Foreign Application Priority Data

Aug. 1, 2016 (JP) ..... 2016-151448

(51) Int. Cl.

| | |
|---|---|
| ***G03G 5/14*** | (2006.01) |
| ***G03G 5/10*** | (2006.01) |
| ***G03G 5/043*** | (2006.01) |
| ***G03G 21/18*** | (2006.01) |

(52) U.S. Cl.

CPC ..... *G03G 5/144* (2013.01); *G03G 5/043* (2013.01); *G03G 5/102* (2013.01); *G03G 21/18* (2013.01)

(58) Field of Classification Search

CPC ..... G03G 5/102; G03G 5/144; G03G 5/14
USPC ..... 430/69, 65, 63, 60
See application file for complete search history.

(56) References Cited

U.S. PATENT DOCUMENTS

| | | | | |
|---|---|---|---|---|
| 5,298,617 | A | 3/1994 | Nukada et al. | |
| 5,302,479 | A | 4/1994 | Daimon et al. | |
| 5,459,004 | A | 10/1995 | Katsumi et al. | |
| 2013/0236822 | A1* | 9/2013 | Ono | G03G 15/75 430/56 |
| 2017/0045833 | A1* | 2/2017 | Sato | G03G 5/005 |

FOREIGN PATENT DOCUMENTS

| | | | |
|---|---|---|---|
| EP | 0 710 893 | A1 | 5/1996 |
| JP | 4-189873 | A | 7/1992 |
| JP | 5-98181 | A | 4/1993 |
| JP | 5-140472 | A | 6/1993 |
| JP | 5-140473 | A | 6/1993 |
| JP | 5-263007 | A | 10/1993 |
| JP | 5-279591 | A | 10/1993 |
| JP | 8-176293 | A | 7/1996 |
| JP | 8-208820 | A | 8/1996 |
| JP | 2004-78147 | A | 3/2004 |
| JP | 2005-181992 | A | 7/2005 |
| JP | 2010-32756 | A | 2/2010 |
| JP | 2012-155282 | A | 8/2012 |
| JP | 2013-205479 | A | 10/2013 |

* cited by examiner

*Primary Examiner* — Janis L Dote

(74) *Attorney, Agent, or Firm* — Sughrue Mion, PLLC

(57) ABSTRACT

An electrophotographic photoreceptor includes a conductive substrate satisfying a condition (A); an undercoat layer satisfying conditions (B) and (C), disposed on the conductive substrate, and containing metal oxide particles; and a photosensitive layer disposed on the undercoat layer: condition (A): in the case where depressions existing in the surface of the conductive substrate are observed with a laser microscope, the width of the largest depression is 400 μm or less, and the depth of the depression is 15 μm or less; condition (B): in the case where the undercoat layer is subjected to a Cole-Cole plot analysis, an angular frequency ωmax at which a complex impedance component is maximum is from 2.0 rad to 25.0 rad; and condition (C): volume resistivity obtained from the Cole-Cole plot analysis of the undercoat layer is from $7.0\times10^{7}\Omega$ to $1.0\times10^{9}\Omega$.

14 Claims, 4 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-151448 filed Aug. 1, 2016.

BACKGROUND (i) Technical Field

The present invention relates to an electrophotographic photoreceptor, a process cartridge, and an image forming apparatus.

(ii) Related Art

Electrophotographic image forming apparatuses enable high-speed and high-quality printing and are therefore applied to image forming apparatuses such as copying machines and laser beam printers. The mainstream of electrophotographic photoreceptors used in image forming apparatuses is an organic photoreceptor containing an organic photoconductive material. In general production of the organic photoreceptor, for example, an undercoat layer (also referred to as "intermediate layer") is formed on a conductive substrate, such as an aluminum substrate, and then a photosensitive layer is formed thereon.

In an example of known processes for producing a conductive substrate, for example, the peripheral surface of a cylindrical tube produced by extruding and subsequent drawing is subjected to machining to adjust, for instance, the thickness and surface roughness thereof.

A known process for producing a thin metal container in large quantities at low production costs is impact pressing in which slag placed on a die (female die) is formed into a cylinder by being punched with impact. The edge surface of the cylindrical product produced by the impact pressing is removed, so that a conductive substrate that can be used in electrophotographic photoreceptors (also referred to as "impact-pressed tube" or "IP tube") can be produced at low cost.

Alternatively, another type of conductive substrate that can be used in electrophotographic photoreceptors can be produced merely by extruding and subsequent drawing such as cold drawing (also referred to as "drawn tube" or "ED tube").

SUMMARY

According to an aspect of the invention, there is provided an electrophotographic photoreceptor including a conductive substrate that satisfies a condition (A); an undercoat layer that satisfies conditions (B) and (C), that is disposed on the conductive substrate, and that contains metal oxide particles; and a photosensitive layer that is disposed on the undercoat layer, wherein the conditions (A) to (B) are as follows:

condition (A): in the case where depressions existing in the surface of the conductive substrate are observed with a laser microscope, the width of the largest depression is 400 μm or less, and the depth of the depression is 15 μm or less;

condition (B): in the case where the undercoat layer is subjected to a Cole-Cole plot analysis, an angular frequency ωmax at which a complex impedance component is maximum is in the range of from 2.0 rad to 25.0 rad; and condition (C): volume resistivity obtained from the Cole-Cole plot analysis of the undercoat layer is in the range of from $7.0\times10^{7}\Omega$ to $1.0\times10^{9}\Omega$.

BRIEF DESCRIPTION OF THE DRAWINGS

Exemplary embodiments of the present invention will be described in detail based on the following figure(s), wherein.

DETAILED DESCRIPTION

Figure 1:
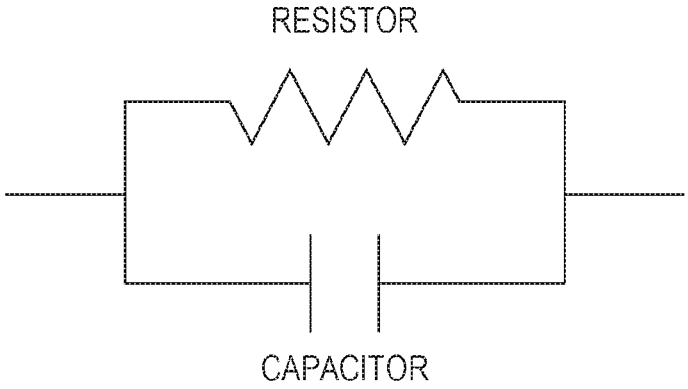
FIG. 1 schematically illustrates a parallel circuit including a resistor and a capacitor.

Exemplary embodiments that are examples of the invention will now be described in detail.

Electrophotographic Photoreceptor

An electrophotographic photoreceptor according to a first exemplary embodiment (also referred to as "photoreceptor") includes a conductive substrate that satisfies the following condition (A); an undercoat layer that satisfies the following conditions (B) and (C), that is disposed on the conductive substrate, and that contains metal oxide particles; and a photosensitive layer that is disposed on the undercoat layer.

Condition (A): in the case where depressions existing in the surface of the conductive substrate are observed with a laser microscope, the width of the largest depression is 400 μm or less, and the depth thereof is 15 μm or less Condition (B): in the case where the undercoat layer is subjected to a Cole-Cole plot analysis, an angular frequency ωmax at which a complex impedance component is maximum is in the range of from 2.0 rad to 25.0 rad Condition (C): volume resistivity obtained from the Cole-Cole plot analysis of the undercoat layer is in the range of from $7.0\times10^{7}\Omega$, to $1.0\times10^{9}\Omega$ The photoreceptor of the first exemplary embodiment includes the conductive substrate satisfying the condition (A) and the undercoat layer satisfying the conditions (B) and (C) and containing metal oxide particles, which enables a reduction in the occurrence of defective image quality of white spots brought about by depressions existing in the surface of the conductive substrate.

Using the IP tube or ED tube described above as a conductive substrate typically causes depressions of various sizes to be formed at specific part of the surface of the conductive substrate in some cases, and the number of the depressions depends on the individual cases. In the case where a photosensitive layer or another layer is formed on the peripheral surface of such a conductive substrate having the depressions to produce a photoreceptor and where the photoreceptor is used in an image forming apparatus to form a toner image, the presence of the depressions in the surface of the conductive substrate leads to the occurrence of defective image quality of white spots in some cases. The occurrence of white spots is likely to result in a reduction in the quality of output images.

In the case where an ED tube or an IP tube is used as a conductive substrate, defective image quality of white spots caused by depressions existing in the surface thereof is less likely to be prevented.

It is believed that using such a conductive substrate having depressions formed in the surface thereof in a photoreceptor causes the occurrence of defective image quality of white spots, which is brought about by the depressions, for the following mechanism.

In the charging step in a so-called electrophotographic process, charging causes the concentration of an electric field at the edge of the depressed part on the surface of the conductive substrate, and thus the charging is likely to become uneven at the depressed part. Such uneven charging disrupts electric potential attenuated by image exposure. As a result, disrupted exposure potential leads to the occurrence of defective image quality of white sports. In other words, it is speculated that the occurrence of defective image quality of white sports is attributed to the depressions existing in the surface of the conductive substrate.

The undercoat layer containing metal oxide particles serves to prevent positive charges from flowing from the conductive substrate into the photosensitive layer; however, it is believed that the high mobility of positive charges in the undercoat layer makes it difficult to reduce the inflow of the positive charges and also readily causes the concentration of an electric field at the edge of the depressed part on the surface of the conductive substrate in a charging step.

In view of such circumstances, the conductive substrate satisfying the condition (A) and the undercoat layer satisfying the conditions (B) and (C) and containing metal oxide particles are used in combination in the photoreceptor of the first exemplary embodiment. This enables the movement of the positive charges in the undercoat layer to be properly controlled, so that the concentration of an electric field at the edge of the depressed part on the surface of the conductive substrate may be reduced. The mechanism thereof has been still studied and is assumed to be as follows.

The detail of the condition (A) will now be described.

When the width and depth of the largest depression are within the above-mentioned ranges as defined by the condition (A), a depression having excessively large width and depth is less likely to exist in the surface of the conductive substrate. Hence, the effect of the concentration of an electric field, which is generated at the edge of the depressed part owing to the shape of the depression itself, can be easily reduced.

The detail of the condition (B) will now be described.

When the angular frequency ωmax at which a complex impedance component in the undercoat layer subjected to a Cole-Cole plot analysis (imaginary component Z" of impedance Z that will be described later) is maximum is 25.0 rad or less, positive charges in the undercoat layer are less likely to move relative to the width and depth of the depression that are defined by the condition (A).

The degree of the easy movement of positive charges in the undercoat layer can be estimated on the basis of the angular frequency ωmax at which imaginary component Z" of impedance Z is maximum, although the detail will be described later. In particular, when the angular frequency ωmax is small, the speed of the movement of charges relative to alternating-current voltage applied in the Cole-Cole plot analysis becomes slow, which means that positive charges in the undercoat layer are less likely to move.

Hence, the angular frequency ωmax is adjusted to be 25.0 rad or less to make the positive charges in the undercoat layer less likely to move. In terms of avoiding a reduction in image density, however, the lower limit of the angular frequency ωmax is 2 rad.

The detail of the condition (C) will now be described.

When the volume resistivity obtained from the Cole-Cole plot analysis of the undercoat layer is large, the positive and negative charges themselves in the undercoat layer are less likely to move. In particular, in the condition (C), the volume resistivity of the undercoat layer is adjusted to be $7.0\times10^{7}\Omega$ or more to control the positive and negative charges in the undercoat layer to be less likely to move. In terms of avoiding a reduction in image density, however, the upper limit of the volume resistivity is $1.0\times10^{9}\Omega$.

Accordingly, in the photoreceptor of the first exemplary embodiment, the conductive substrate satisfying the condition (A) and the undercoat layer satisfying the conditions (B) and (C) and containing metal oxide particles are used in combination, so that the positive charges in the undercoat layer are less likely to move (that is, the movement of the positive charges in the undercoat layer is appropriately controlled); thus, the movement of the positive charges from the conductive substrate to the photosensitive layer is reduced. Consequently, the concentration of an electric field at the edge of the depression existing in the surface of the conductive substrate is reduced during a charging step, and thus uneven charging at the depressed part is less likely to occur. As a result, defective image quality of white spots brought about by the depression existing in the surface of the conductive substrate is reduced.

The angular frequency ωmax that provides the maximum complex impedance component (imaginary component Z" of impedance Z) in the Cole-Cole plot analysis will now be described.

In general, for example, a parallel circuit including a resistor (resistance: R, hereinafter corresponding to volume resistivity in the first exemplary embodiment) and a capacitor (capacitance: C) is applied to an equivalent circuit of conductive organic films used as layers of the electrophotographic photoreceptor. The Cole-Cole plot analysis can be used as a technique for analyzing and calculating the resistance R and the capacitance C in the parallel circuit in which the resistance R and the capacitance C are unclear.

In the Cole-Cole plot analysis, electrodes are attached to both ends of a parallel circuit (for example, conductive organic film) having an unclear resistance R and capacitance C, an alternating-current voltage is applied between the electrodes while the frequency thereof is changed, and a phase relationship between the applied voltage and the obtained electric current is analyzed. This technique enables the resistance R and capacitance C of the parallel circuit to be determined.

The principles of the measurement and analysis will now be described.

When a parallel circuit illustrated in FIG. 1 {parallel circuit including a resistor (resistance: R) and a capacitor (capacitance: C)} is given, the impedance Z of the parallel circuit is defined by Expression (I). In the expression, i represents an imaginary number, and ω represents the angular frequency (rad) of voltage applied to the parallel circuit.

$$1/Z=1/R+i\omega C \quad \text{Expression (I)}$$

Then, Expression (I) is rewritten into Expression (II) as follows.

$$Z=R/(1+\omega^2R^2C^2)-i\ [\omega R^2C/(1+\omega^2R^2C^2)] \quad \text{Expression (II)}$$

When the impedance Z is expressed using an actual number component Z' and an imaginary component Z", the impedance Z is defined by Expression (III).

$$Z=Z'+iZ'' \quad \text{Expression (III)}$$

In addition, the actual number component Z' and the imaginary component Z" are defined by Expression (IV) and Expression (V), respectively.

$$Z'=R/(1+\omega^2R^2C^2) \quad \text{Expression (IV)}$$

$$Z''=\omega R^2C/(1+\omega^2R^2C^2) \quad \text{Expression (V)}$$

When ω is eliminated from Expression (IV) and Expression (V), Expression (VI) is finally obtained.

$$(Z'-R/2)^2+Z''^2=(R/2)^2 \quad \text{Expression (VI)}$$

Figure 2:
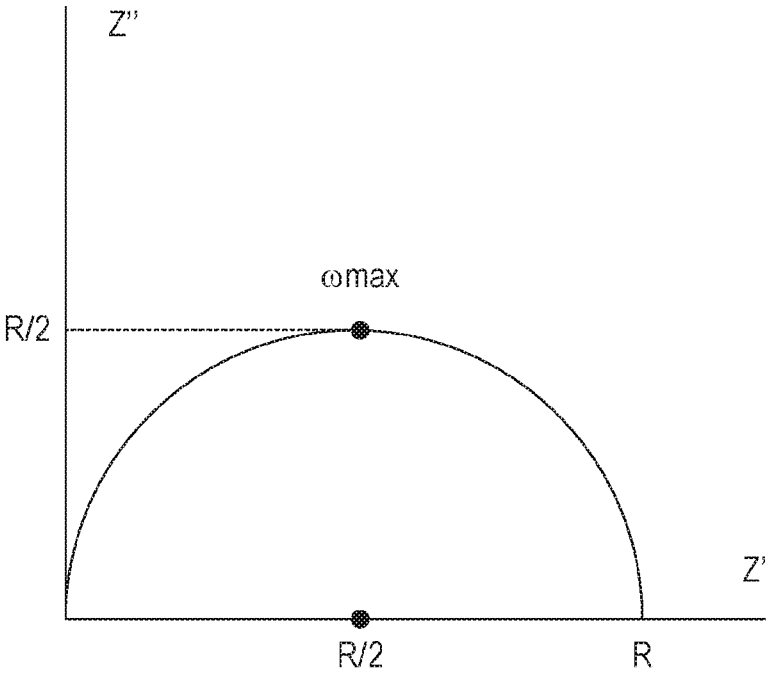
FIG. 2 is a conceptual diagram illustrating a Cole-Cole plot analysis.

When the imaginary component Z" is on the vertical axis and the actual number component Z' is on the horizontal axis to give a conceptual diagram illustrated in FIG. 2, Expression (VI) shows that the actual number component Z' and the imaginary component Z" are in the shape of a semicircle with the center of coordinates (R/2, 0). The angular frequency at the point where the imaginary component Z" is maximum is ωmax (rad), and this ωmax is a point where the capacitance component is maximum.

Accordingly, in the case where alternating-current voltage is applied to the parallel circuit having an unclear resistance R and capacitance C while the frequency thereof is changed, the diagram illustrated in FIG. 2 can be drawn from an obtained phase difference between the absolute values of the electric current and applied voltage. Then, the resistance R, the angular frequency ωmax, and the capacitance C can be calculated from this diagram.

In the photoreceptor of the first exemplary embodiment, the angular frequency ωmax and the resistance R (corresponding to volume resistivity in the first exemplary embodiment) are adjusted to be within the above-mentioned ranges on the basis of such a diagram to properly control the movement of positive charges in the undercoat layer.

The electrophotographic photoreceptor of the first exemplary embodiment will now be described in detail with reference to the drawings.

Figure 3:
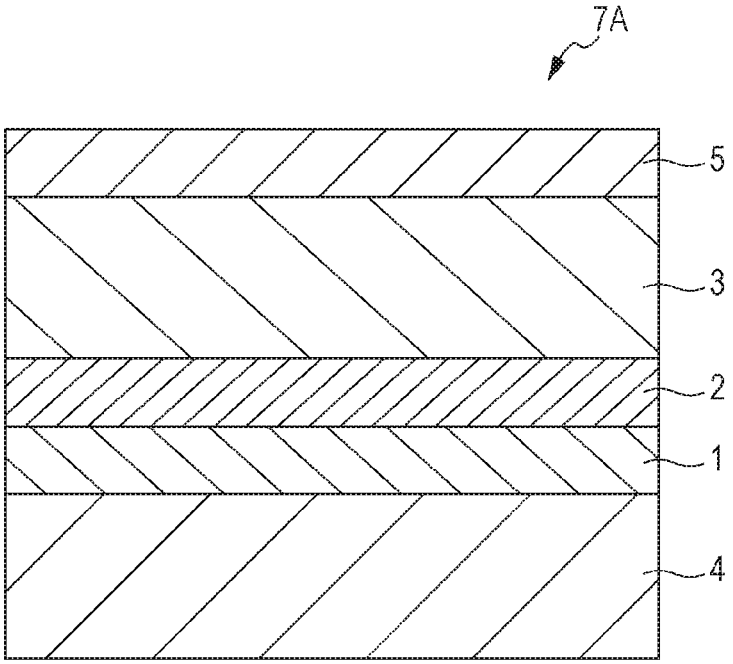
FIG. 3 is a schematic cross-sectional view partially illustrating an example of the layered structure of an electrophotographic photoreceptor according to a first exemplary embodiment.
Figure 4:
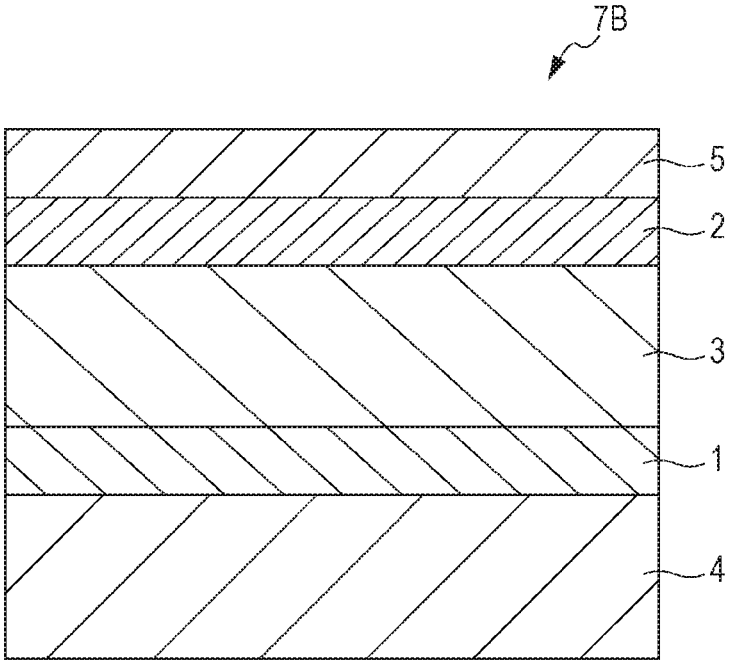
FIG. 4 is a schematic cross-sectional view partially illustrating another example of the layered structure of the electrophotographic photoreceptor according to the first exemplary embodiment.
Figure 5:
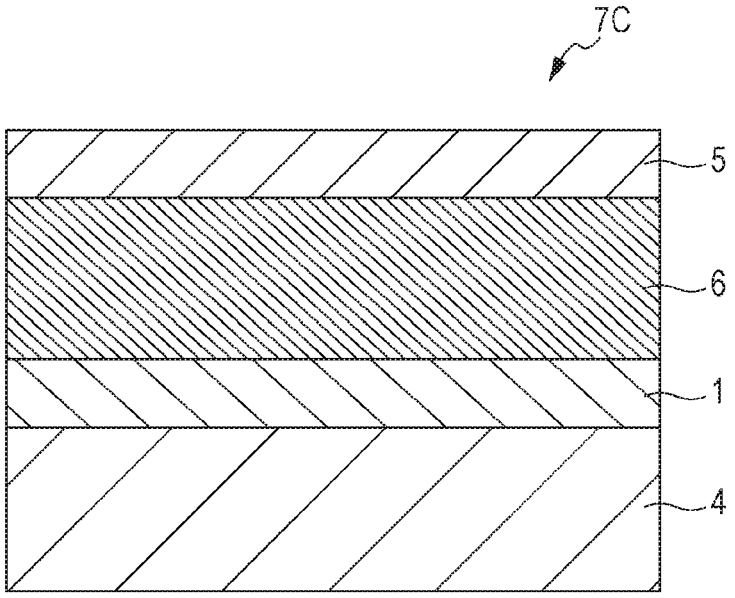
FIG. 5 is a schematic cross-sectional view partially illustrating another example of the layered structure of the electrophotographic photoreceptor according to the first exemplary embodiment.

FIG. 3 is a schematic cross-sectional view illustrating an example of the electrophotographic photoreceptor of the first exemplary embodiment. FIGS. 4 and 5 are each a schematic cross-sectional view illustrating another example of the electrophotographic photoreceptor of the first exemplary embodiment.

An electrophotographic photoreceptor 7A illustrated in FIG. 3 is a so-called functionally-separated photoreceptor (layered photoreceptor) and includes a conductive substrate 4; an undercoat layer 1 formed thereon; and a charge-generating layer 2, charge-transporting layer 3, and protective layer 5 disposed in sequence so as to overlie the conductive substrate 4 and the undercoat layer 1. In the electrophotographic photoreceptor 7A, the charge-generating layer 2 and the charge-transporting layer 3 constitute a photosensitive layer.

An electrophotographic photoreceptor 7B illustrated in FIG. 4 is a functionally-separate photoreceptor in which the charge-generating layer 2 and the charge-transporting layer 3 are functionally separated as in the electrophotographic photoreceptor 7A illustrated in FIG. 3.

The electrophotographic photoreceptor 7B illustrated in FIG. 4 includes the conductive substrate 4; the undercoat layer 1 formed thereon; and the charge-transporting layer 3, charge-generating layer 2, and protective layer 5 disposed in sequence so as to overlie the conductive substrate 4 and the undercoat layer 1. In the electrophotographic photoreceptor 7B, the charge-transporting layer 3 and the charge-generating layer 2 constitute a photosensitive layer.

In an electrophotographic photoreceptor 7C illustrated in FIG. 5, a charge-generating material and a charge-transporting material are used in a single layer (single photosensitive layer 6). The electrophotographic photoreceptor 7C illustrated in FIG. 3 includes the conductive substrate 4, the undercoat layer 1 formed thereon, and the single photosensitive layer 6 and protective layer 5 disposed in sequence so as to overlie the conductive substrate 4 and the undercoat layer 1.

In the electrophotographic photoreceptors 7A, 7B, and 7C illustrated in FIGS. 3, 4, and 5, respectively, the protective layer 5 is the outermost layer disposed most remote from the conductive substrate 4.

Each part of the electrophotographic photoreceptor 7A illustrated in FIG. 3 will now be described as a representative example. Reference signs are omitted for the sake of convenience.

Conductive Substrate

Examples of the conductive substrate include metal plates, metal drums (metal cylinders), and metal belts containing metals (such as aluminum, copper, zinc, chromium, nickel, molybdenum, vanadium, indium, gold, and platinum) or alloys (such as stainless steel). Other examples of the conductive substrate include paper, resin films, and belts each having a coating film formed by applying, depositing, or laminating conductive compounds (such as conductive polymers and indium oxide), metals (such as aluminum, palladium, and gold), or alloys. The term "conductive" herein refers to having a volume resistivity that is less than $10^{13}$ Ωcm.

In particular, a metal cylinder is suitably used. A metal cylinder can be an impact-pressed tube (IP tube) formed by impact pressing or a drawn tube (ED tube) formed by drawing. Particularly in the case of using an IP tube as the metal cylinder, a metal cylinder primarily containing aluminum is suitably used. The term "primarily containing" refers to that the aluminum content in the metal cylinder is greater than 50 weight %.

In the photoreceptor of the first exemplary embodiment, the conductive substrate satisfies the condition (A).

Condition (A): in the case where depressions existing in the surface of the conductive substrate are observed with a laser microscope, the width of the largest depression is 400 μm or less, and the depth thereof is 15 μm or less The width and depth of the largest depression, which are defined by the condition (A), can be in the following ranges in order to reduce defective image quality of white spots brought about by depressions existing in the surface of the conductive substrate.

Width of Largest Depression According to Condition (A)

The width of the largest depression is 400 μm or less, preferably 380 μm or less, and more preferably 355 μm or less. The lower limit thereof can be 12 μm.

Depth of Largest Depression According to Condition (A)

The depth of the largest depression is 15 μm or less, preferably 14 μm or less, and more preferably 12 μm or less. The lower limit thereof can be 3 μm.

Measurement of Width and Depth of Largest Depression

The width of the largest depression is measured as follows.

The following regions in the axial direction of the conductive substrate are determined with an optical microscope: a region having a diameter of 6 mm with the center that is 50 mm away from one end of the conductive substrate, a region having a diameter of 6 mm with the center that is 50 mm away from the other end of the conductive substrate, and a region having a diameter of 6 mm and positioned at the center of the conductive substrate between these two regions. Then, another three sets of such three regions are determined such that the four sets of the regions are spaced apart from each other by 90 degrees in the circumferential direction of the conductive substrate. In other words, 3 regions in the axial direction and 4 regions in the circumferential direction are determined on the surface of the conductive substrate, namely 12 regions in total.

Then, the surfaces of depressions (depressed parts) existing in the 12 regions are observed with a laser microscope (type OLS1100, manufactured by Olympus Corporation) to form the images thereof, and then widths of the depressions are determined. The width of the largest depression that is defined by the condition (A) is the maximum value among the widths of the observed depressions.

The depth of the largest depression is measured as follows.

The cross sections of depressions existing in the 12 regions are observed with the laser microscope to form the images thereof, and then the depth of each of the depressions is measured. The depth of the largest depression that is defined by the condition (A) is the maximum value among the depths of the observed depressions.

Examples of the shape of the depression in its cross section include, but are not limited to, circular shapes such as an ellipse, polygonal shapes such as a rhombus and a rectangle, and amorphous shapes.

The conductive substrate that satisfies the condition (A) can be produced by any technique; for example, a conductive substrate is formed by a known technique such as impact pressing or drawing, and the surface of the conductive substrate is processed by, for example, etching, anodic oxidation, rough grinding, centerless grinding, blasting (for instance, sand blasting), or wet honing.

Particularly in the case where the conductive substrate is produced by impact pressing, the surface of a metal ingot used for producing the conductive substrate, namely a material to be processed (hereinafter also referred to as "slag"), is preliminarily damaged (depressed part is formed), thereby producing the conductive substrate that satisfies the condition (A).

The thickness of the conductive substrate is not particularly limited. In the case where the conductive substrate is an IP tube, the thickness is preferably in the range of from 0.25 mm to 0.8 mm, more preferably from 0.4 mm to 0.7 mm, and further preferably from 0.4 mm to 0.5 mm.

In the case where the conductive substrate is an ED tube, the thickness is preferably in the range of from 0.25 mm to 0.8 mm, more preferably from 0.4 mm to 0.7 mm, and further preferably from 0.4 mm to 0.5 mm.

The conductive substrate is optionally subjected to a treatment with an acidic treatment liquid or a boehmite treatment.

An example of the treatment with an acidic treatment liquid is as follows. An acidic treatment liquid containing a phosphoric acid, a chromic acid, and a hydrofluoric acid is prepared. The amounts of the phosphoric acid, chromic acid, and hydrofluoric acid in the acidic treatment liquid are, for instance, in the range of from 10 weight % to 11 weight %, from 3 weight % to 5 weight %, and from 0.5 weight % to 2 weight %, respectively; the total concentration of the whole acids are suitably from 13.5 weight % to 18 weight %. The treatment temperature is, for example, suitably in the range of from 42° C. to 48° C. The thickness of the coating film is suitably from 0.3 μm to 15 μm.

The boehmite treatment, for instance, involves a soak in pure water at a temperature ranging from 90° C. to 100° C. for from 5 to 60 minutes or contact with heated steam at a temperature ranging from 90° C. to 120° C. for from 5 to 60 minutes. The thickness of the coating film is suitably from 0.1 μm to 5 μm. The coating film is optionally further subjected to an anodic oxidation treatment with an electrolyte solution that less dissolves the coating film, such as adipic acid, boric acid, borate, phosphate, phthalate, maleate, benzoate, tartrate, or citrate.

Undercoat Layer

In the photoreceptor of the first exemplary embodiment, the undercoat layer contains metal oxide particles. An example of the undercoat layer is a layer containing metal oxide particles and a binder resin. The undercoat layer used in the first exemplary embodiment satisfies the conditions (B) and (C) as described above.

Condition (B): in the case where the undercoat layer is subjected to a Cole-Cole plot analysis, an angular frequency ωmax at which a complex impedance component is maximum is in the range of from 2.0 rad to 25.0 rad Condition (C): volume resistivity obtained from the Cole-Cole plot analysis of the undercoat layer is in the range of from $7.0\times10^{7}\Omega$ to $1.0\times10^{9}\Omega$.

The angular frequency ωmax defined by the condition (B) (also simply referred to as "angular frequency ωmax") and the volume resistivity defined by the condition (C) (also simply referred to as "volume resistivity") can be in the following ranges in order to reduce defective image quality of white spots brought about by depressions existing in the surface of the conductive substrate.

Angular Frequency ωmax According to Condition (B)

The angular frequency ωmax is preferably in the range of from 2.0 rad to 25.0 rad, more preferably from 2.0 rad to 15.0 rad, and further preferably from 2.0 rad to 14.0 rad.

At an angular frequency ωmax of 25.0 rad or less, positive charges are less likely to move in the undercoat layer, so that the concentration of an electric field at the edge of a depression existing in the surface of the conductive substrate is likely to be reduced in a charging step. Hence, defective image quality of white sports brought about by the depression existing in the surface of the conductive substrate is less likely to be generated.

At an angular frequency ωmax of 2.0 rad or more, controlling the movement of positive charges in the undercoat layer is very difficult, and the charges are therefore less likely to be accumulated in the undercoat layer after long-term use. Thus, electric potential after exposure for forming an image is secured, so that a decrease in image density is reduced.

Volume Resistivity According to Condition (C)

The volume resistivity is in the rage of from $7.0\times10^{7}\Omega$ to $1.0\times10^{9}\Omega$, preferably from $7.0\times10^{7}\Omega$ to $2.0\times10^{8}\Omega$, and more preferably from $7.0\times10^{7}\Omega$ to $1.0\times10^{8}\Omega$.

At a volume resistivity of $1.0\times10^{9}\Omega$ or less, controlling the movement of positive and negative charges in the undercoat layer is very difficult, and the charges are therefore less likely to be accumulated in the undercoat layer after long-term use. Thus, electric potential after exposure for forming an image is secured, so that a decrease in image density is reduced.

At a volume resistivity of $7.0\times10^{7}\Omega$ or more, positive and negative charges are less likely to move in the undercoat layer, so that the concentration of an electric field at the edge of a depression existing in the surface of the conductive substrate is likely to be reduced in a charging step. Hence, defective image quality of white sports brought about by the depression existing in the surface of the conductive substrate is less likely to be generated.

Measurement of Angular Frequency ωmax and Volume Resistivity

The angular frequency ωmax and volume resistivity are measured as follows.

In the measurement, a power source that is SI1287 electrochemical interface (manufactured by TOYO Corporation), a current amplifier that is DIELECTRIC INTERFACE solartron 1296 (manufactured by TOYO Corporation), an ammeter that is IMPEDANCE/GAIN-PHASE ANALYZER solartron SI1260 (manufactured by TOYO Corporation), and a measuring software that is Solartron Material Research and Test software Ver.3.0.1 (manufactured by solartron analytical) are used.

An alternating-current voltage of 1 Vp-p is applied between a conductive substrate (for example, aluminum substrate) as a cathode and a gold electrode as an anode from the higher side of a frequency ranging from 1 MHz to 1 mHz to measure alternating-current impedance.

Results of the measurement are used to perform a Cole-Cole plot analysis with an analytical software Zview Ver.3.1c (manufactured by Scribner Associates Inc.). In particular, a graph having two axes of the actual number component Z' and the imaginary component Z" of the obtained impedance Z is formed, and semicircular fitting is performed with values between the point of the coordinate of (Z', Z") as (0, 0) and the point giving the maximum imaginary component Z" to determine the angular frequency ωmax at which the complex impedance component (imaginary component Z" of impedance Z) is maximum. In addition, volume resistivity and capacitance C are determined from the obtained graph having the two axes.

Other equipment can be used provided that the same measurement can be performed. Specific measurement of the angular frequency ωmax and volume resistivity will be described in Examples.

The angular frequency ωmax and the volume resistivity in a photoreceptor that is to be subjected to the measurement are determined as follows.

A photoreceptor that is to be subjected to the measurement is prepared. Then, for example, the photosensitive layer coating the undercoat layer, such as the charge-generating layer and the charge-transporting layer, is removed with a solvent, such as acetone, tetrahydrofuran, methanol, or ethanol, to expose the undercoat layer. A gold metal electrode is formed on the exposed undercoat layer by vacuum deposition or sputtering to yield a measurement sample. The measurement sample is subjected to the measurement with the above-mentioned measurement equipment to determine the angular frequency ωmax and volume resistivity.

In the photoreceptor of the first exemplary embodiment, the angular frequency ωmax and volume resistivity can be controlled by, for example, adjustment of the particle distribution of the metal oxide particles.

In the case where the particle distribution of the metal oxide particles is large, the distribution of the distance between the metal oxide particles is large. Furthermore, an organic material that is present in the distance between the metal oxide particles, such as a binder, is likely to make a response speed to the alternating-current voltage in the Cole-Cole plot analysis slow. This means that positive charges in the undercoat layer are less likely to move. Accordingly, the angular frequency ωmax tends to be small, and the volume resistivity tends to be large.

For instance, in the case where the undercoat layer is formed by formation of a coating film of an undercoat-layer-forming coating liquid in which the metal oxide particles have been dispersed, the primary particles of the metal oxide particles may exist in the film of the undercoat layer together with the secondary particles that are the agglomerates of the primary particles. The secondary particles of the metal oxide particles have a larger diameter than the primary particles, and the presence of the secondary particles easily leads to the formation of the path through which charges move. In the case where the secondary particles of the metal oxide particles cause unnecessary movement of the charges in the undercoat layer, the movement of the charges into the photosensitive layer becomes less likely to be reduced. Meanwhile, in the case where the particles are unnecessarily distributed and where the number of the primary particles of the metal oxide particles therefore increases in the undercoat layer, charges become less likely to move, which results in an easy reduction in image density. Hence, adjusting the particle distribution enables movement of positive charges in the undercoat layer to be properly controlled; in other words, in the first exemplary embodiment, the positive charges in the undercoat layer are controlled so as to be less likely to move. Thus, the angular frequency ωmax and volume resistivity can be controlled so as to be within the above-mentioned ranges.

An example of a technique for adjusting the particle distribution of the metal oxide particles is a technique that involves using an undercoat-layer-forming coating liquid that is a mixture of a dispersion liquid X as a first undercoat-layer-forming coating liquid containing first metal oxide particles (for instance, dispersion liquid A that will be described later in Examples) and a dispersion liquid Y as a second undercoat-layer-forming coating liquid containing second metal oxide particles (for instance, dispersion liquid B that will be described later in Examples).

The diameter of the first metal oxide particles in the dispersion liquid X is smaller than that of the second metal oxide particles in the dispersion liquid Y.

An example of specific adjustment of the particle distribution of the metal oxide particles is as follows. In a step for dispersing the metal oxide particles of the undercoat-layer forming coating liquid, the dispersion is carried out for a long period of time in an undercoat-layer-forming coating liquid having a known solid content concentration of the metal oxide particles to prepare the dispersion liquid X. Then, an undercoat-layer-forming coating liquid having the same solid content concentration as the dispersion liquid X is prepared, and the dispersion is carried out for a shorter period of time than in the preparation of the dispersion liquid X (for example, half the period of the dispersion time in the preparation of the dispersion liquid X) to prepare the dispersion liquid Y.

Carrying out the dispersion for the long period of time to prepare the dispersion liquid X enables the metal oxide particles in the dispersion liquid X to have a small diameter. Since the period of the dispersion time is shorter in the preparation of the dispersion liquid Y than in the preparation of the dispersion liquid X, the metal oxide particles in the dispersion liquid Y have a larger diameter than the metal oxide particles in the dispersion liquid X.

The dispersion liquid X and the dispersion liquid Y are mixed with each other, and then the weight ratio r (%) of the solid content of the metal oxide particles, which is defined by Expression (r), is controlled to adjust the particle distribution of the metal oxide particles. Controlling the weight ratio r enables the angular frequency ωmax and volume resistivity to be adjusted to be within the above-mentioned ranges.

$$r=\{X/(X+Y)\}\times 100 \qquad \text{Expression (r)}$$

In Expression (r), X represents the solid content of the metal oxide particles in the dispersion liquid X (parts by weight), and Y represents the solid content of the metal oxide particles in the dispersion liquid Y (parts by weight).

In the above-mentioned example, the dispersion time in the preparation of the dispersion liquid Y is half the period of the dispersion time in the preparation of the dispersion liquid X; however, the difference in the dispersion time between the dispersion liquid X and the dispersion liquid Y is not particularly limited provided that the angular frequency ωmax and the volume resistivity can be controlled to be within the above-mentioned ranges. The case where the solid content of the metal oxide particles in the dispersion liquid X is the same as the solid content of the metal oxide particles in the dispersion liquid Y has been described; however, the solid contents are not particularly limited likewise.

The technique in which the undercoat-layer-forming coating liquid in which the diameter of the metal oxide particles is small and the undercoat-layer-forming coating liquid in which the diameter of the metal oxide particles is large are mixed with each other has been described; however, another technique may be employed.

Examples of the metal oxide particles include metal oxide particles having a powder resistance (volume resistivity) ranging from $10^2$ Ωcm to $10^{11}$ Ωcm.

Specific examples of the metal oxide particles having such a resistance include metal oxide particles such as tin oxide particles, titanium oxide particles, zinc oxide particles, and zirconium oxide particles; in particular, zinc oxide particles are suitable.

The specific surface area of the metal oxide particles, which is measured by a BET method, is, for example, suitably 10 $m^2/g$ or more.

The volume average particle diameter of the metal oxide particles is, for instance, suitably from 50 nm to 2000 nm (preferably from 60 nm to 1000 nm).

The metal oxide particle content is, for example, preferably in the range of from 10 weight % to 80 weight %, and more preferably from 40 weight % to 80 weight % relative to the binder resin content.

The metal oxide particles are optionally subjected to a surface treatment. Two or more types of metal oxide particles having difference in surface treatment or particle size may be used in combination.

Examples of a surface treatment agent to be used include a silane coupling agent, a titanate-based coupling agent, an aluminum-based coupling agent, and a surfactant. In particular, a silane coupling agent is preferred, and a silane coupling agent having an amino group is more preferred.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination; for example, the silane coupling agent having an amino group may be used in combination with another silane coupling agent. Examples of such another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Any of known surface treatments with surface treatment agents may be employed, and either of a dry process and a wet process may be performed.

The amount of a surface treatment agent to be used is, for instance, suitably from 0.5 weight % to 10 weight % relative to the metal oxide particle content.

The undercoat layer may contain an electron-accepting compound (acceptor compound) in addition to the metal oxide particles in terms of enhancements in the long-term stability of electric properties and carrier-blocking properties.

Examples of the electron-accepting compound include electron-transporting materials, for instance, quinone compounds such as chloranil and bromoanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, the electron-accepting compound is suitably a compound having an anthraquinone structure. Suitable examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

Compound Having Anthraquinone Structure with Hydroxy Group

Among the compounds having an anthraquinone structure, a compound having an anthraquinone structure with a hydroxy group can be especially used in view of controlling the movement of positive charges in the undercoat layer. The compound having an anthraquinone structure with a hydroxy group is a compound in which at least one hydrogen atom of the aromatic rings in the anthraquinone structure has been substituted with a hydroxy group; in particular, a compound represented by General Formula (1) or a compound represented by General Formula (2) is preferred, and the compound represented by General Formula (1) is more preferred.

General Formula (1)

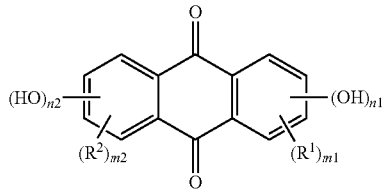

In General Formula (1), n1 and n2 each independently represent an integer from 0 to 4. At least any one of n1 and n2, however, represents an integer from 1 to 4 (in other words, n1 and n2 do not represent 0 at the same time). m1 and m2 each independently represent an integer of 0 or 1. $R^1$ and $R^2$ each independently represent an alkyl group having from 1 to 10 carbon atoms, an alkoxy group having from 1 to 10 carbon atoms, or a substituted or unsubstituted aryl group having from 6 to 30 carbon atoms.

General Formula (2)

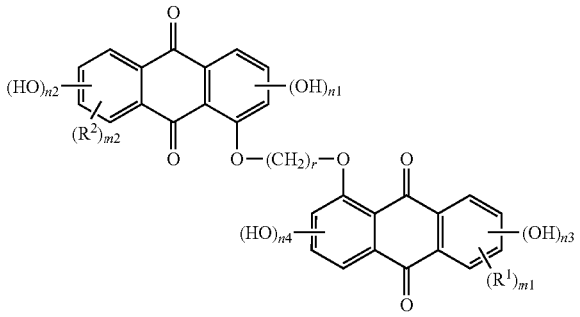

In General Formula (2), n1, n2, n3, and n4 each independently represent an integer from 0 to 3. m1 and m2 each independently represent an integer of 0 or 1. At least any one of n1 and n2 represents an integer from 1 to 3 (in other words, n1 and n2 do not represent 0 at the same time). At least any one of n3 and n4 represents an integer from 1 to 3 (in other words, n3 and n4 do not represent 0 at the same time). r represents an integer from 2 to 10. $R^1$ and $R^2$ each independently represent an alkyl group having from 1 to 10 carbon atoms or an alkoxy group having from 1 to 10 carbon atoms.

In General Formulae (1) and (2), the alkyl group having from 1 to 10 carbon atoms and represented by $R^1$ and $R^2$ may be linear or branched; and examples thereof include a methyl group, an ethyl group, a propyl group, and an isopropyl group. The alkyl group having from 1 to 10 carbon atoms is preferably an alkyl group having from 1 to 8 carbon atoms, and more preferably an alkyl group having from 1 to 6 carbon atoms.

The alkoxy group having from 1 to 10 carbon atoms and represented by $R^1$ and $R^2$ may be linear or branched; and examples thereof include a methoxy group, an ethoxy group, a propoxy group, an isopropoxy group, a butoxy group, and an octoxy group. The alkoxy group having from 1 to 10 carbon atoms is preferably an alkoxy group having from 1 to 8 carbon atoms, and more preferably an alkoxy group having from 1 to 6 carbon atoms.

In General Formula (1), examples of the unsubstituted aryl group having from 6 to 30 carbon atoms and represented by $R^1$ and $R^2$ include a phenyl group, groups formed by removal of one hydrogen atom from alkyl benzene (for instance, a benzyl group, tolyl group, xylyl group, and a mesityl group); a naphthyl group; and groups formed by removal of one hydrogen atom from alkyl-substituted naphthalene.

In General Formula (1), examples of the substituent of the substituted aryl group having from 6 to 30 carbon atoms and represented by $R^1$ and $R^2$ include alkyl groups having from 1 to 6 carbon atoms (for instance, a methyl group, an ethyl group, and a propyl group); the above-mentioned aryl groups having from 6 to 30 carbon atoms; the above-mentioned alkoxy groups having from 1 to 10 carbon atoms; halogen atoms (for instance, a fluorine atom, a chlorine atom, and a bromine atom); a nitro group; an amide group; a hydroxy group; ester groups; ether groups; and an aldehyde group.

Among compounds represented by General Formula (1), any of compounds represented by General Formula (1A) can be particularly used in view of controlling the movement of the positive charges in the undercoat layer.

General Formula (1A)

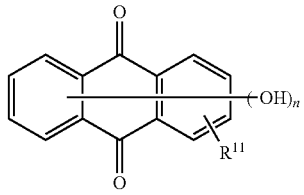

In General Formula (1A), $R^{11}$ represents an alkoxy group having from 1 to 10 carbon atoms or a substituted or unsubstituted aryl group having from 6 to 30 carbon atoms. n represents an integer from 1 to 8.

In General Formula (1A), the alkoxy group having from 1 to 10 carbon atoms and represented by $R^{11}$ has the same meaning as the alkoxy group having from 1 to 10 carbon atoms and represented by $R^1$ and $R^2$ in General Formula (1), and their preferred ranges are also the same as each other.

In General Formula (1A), the unsubstituted aryl group having from 6 to 30 carbon atoms and represented by $R^{11}$ has the same meaning as the unsubstituted aryl group having from 6 to 30 carbon atoms and represented by $R^1$ and $R^2$ in General Formula (1).

In General Formula (1A), the substituent of the substituted aryl group having from 6 to 30 carbon atoms and represented by $R^{11}$ has the same meaning as the substituent of the substituted aryl group having from 6 to 30 carbon atoms and represented by $R^1$ and $R^2$ in General Formula (1).

In General Formula (1A), n is preferably an integer from 1 to 7, and more preferably an integer from 2 to 5.

Specific examples of the electron-accepting compound will now be described; however, the electron-accepting compound is not limited thereto.

Each of the following specific examples of the compound is referred to as "exemplary compound"; for example, a compound described below of (1-1) is referred to as "exemplary compound (1-1)".

In the following exemplary compounds, "Me" refers to a methyl group, "Et" refers to an ethyl group, "Bu" refers to an n-butyl group, "$C_5H_{11}$" refers to an n-pentyl group, "$C_6H_{13}$" refers to an n-hexyl group, "$C_7H_{15}$" refers to an n-heptyl group, "$C_8H_{17}$" refers to an n-octyl group, "$C_9H_{19}$" refers to an n-nonyl group, and "$C_{10}H_{21}$" refers to an n-decyl group.

1-1
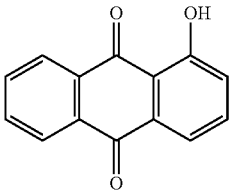
1-2
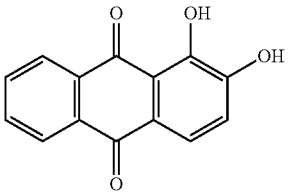
1-3
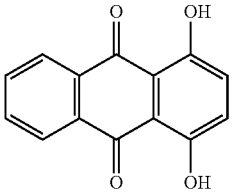
1-4
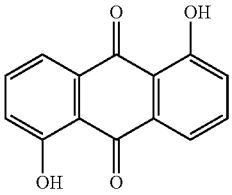
1-5
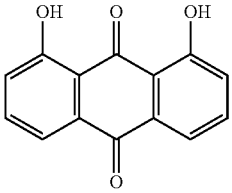
1-6
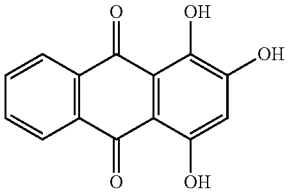
1-7
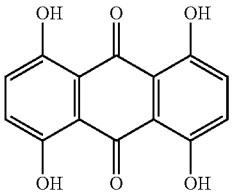
1-8
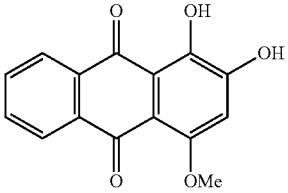
-continued
1-9
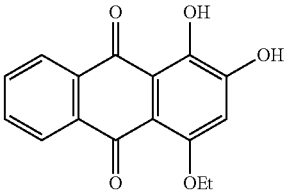
1-10
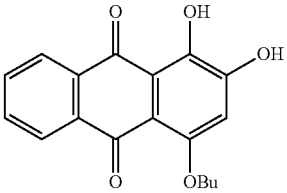
1-11
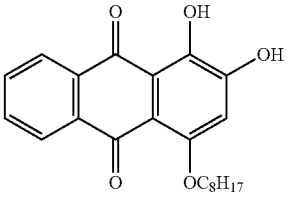
1-12
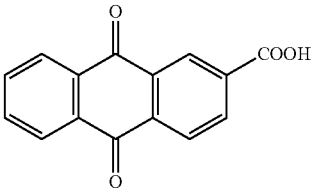
1-13
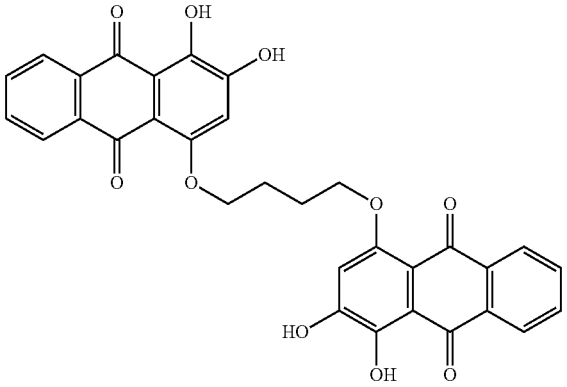
1-14
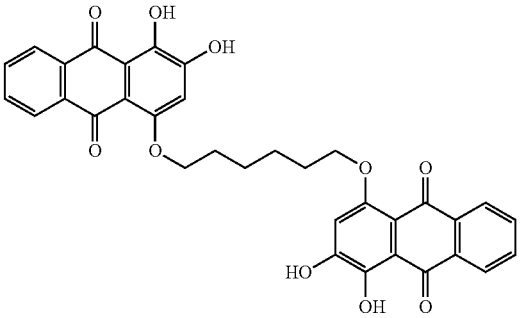

-continued
1-15
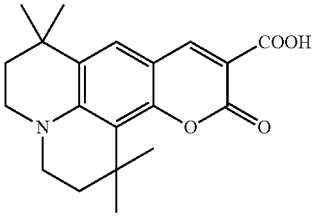
1-16
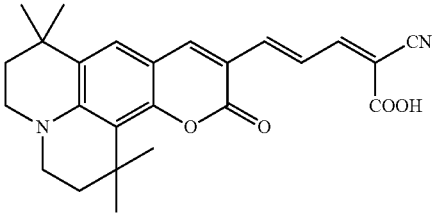
1-17
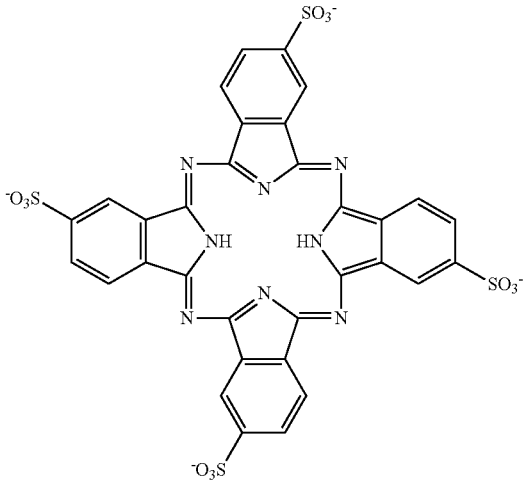
1-18
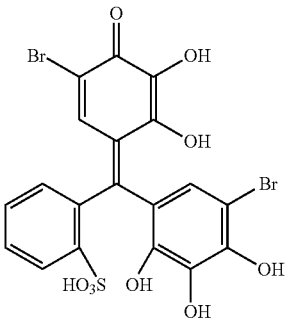
1-19
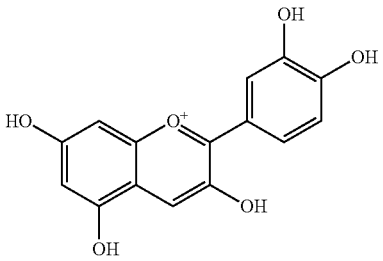
-continued
1-20
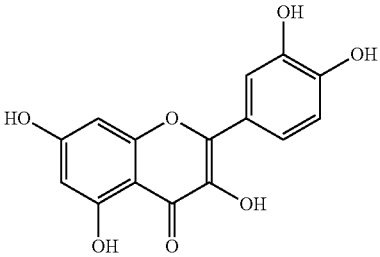
1-21
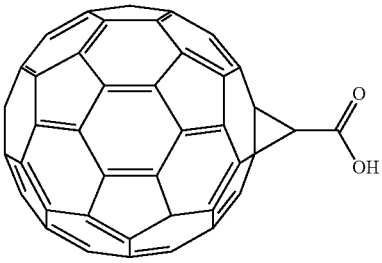
1-22
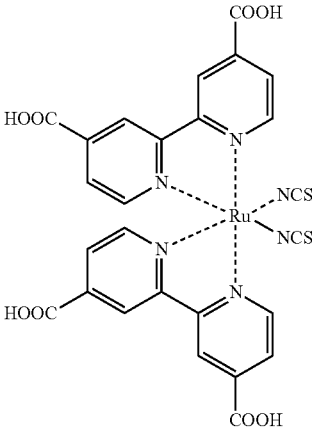
1-23
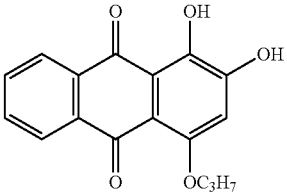
1-24
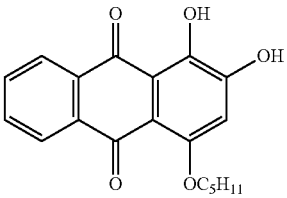
1-25
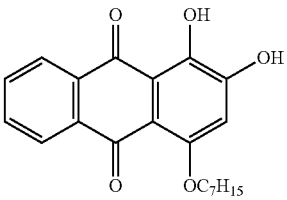

-continued 1-26

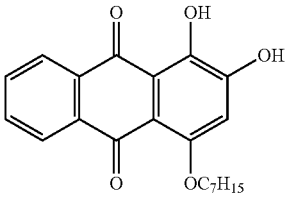

1-27

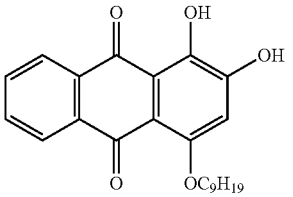

1-28

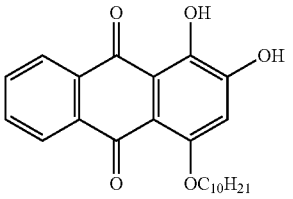

The electron-accepting compound may be contained in the undercoat layer in a state in which it is dispersed along with the metal oxide particles or in a state it is adhering to the surfaces of the metal oxide particles.

The electron-accepting compound is allowed to adhere to the surfaces of the metal oxide particles through, for example, a dry process or a wet process.

In a dry process, for instance, the metal oxide particles are stirred with a mixer or another equipment having a large shear force, and the electron-accepting compound itself or a solution of the electron-accepting compound in an organic solvent is dropped or sprayed with dry air or nitrogen gas thereto under the stirring, thereby allowing the electron-accepting compound to adhere to the surfaces of the metal oxide particles. The dropping or spraying of the electron-accepting compound may be performed at a temperature less than or equal to the boiling point of the solvent. After the dropping or spraying of the electron-accepting compound, the resulting product may be optionally baked at 100° C. or more. The baking may be performed at any temperature for any length of time provided that electrophotographic properties can be produced.

In a wet process, for example, the metal oxide particles are dispersed in a solvent by a technique that involves use of stirring, ultrasonic, a sand mill, an attritor, or a ball mill; the electron-accepting compound is added thereto and then stirred or dispersed; and the solvent is subsequently removed, thereby allowing the electron-accepting compound to adhere to the surfaces of the metal oxide particles. The solvent is removed, for instance, by filtration or distillation. After the removal of the solvent, the resulting product may be optionally baked at 100° C. or more. The baking may be performed at any temperature for any length of time provided that electrophotographic properties can be produced. In the wet process, the moisture content in the metal oxide particles may be removed before the addition of the electron-accepting compound; examples of a technique for the removal include a technique in which the moisture is removed in a solvent under stirring and heating and a technique in which the moisture is removed through azeotropy with a solvent.

The electron-accepting compound may be allowed to adhere to the surfaces of the metal oxide particles before or after the metal oxide particles are subjected to the surface treatment with a surface treatment agent, and the process for the adhesion of the electron-accepting compound and the surface treatment may be performed at the same time.

The amount of the electron-accepting compound is, for example, suitably in the range of from 0.01 weight % to 20 weight %, and preferably from 0.01 weight % to 10 weight % relative to the metal oxide particle content.

Examples of the binder resin used for forming the undercoat layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents.

Other examples of the binder resin used for forming the undercoat layer include charge-transporting resins having charge-transporting groups and conductive resins (e.g., polyaniline).

The binder resin used for forming the undercoat layer is suitably insoluble in a solvent used to form the upper layer. In particular, suitable resins are thermosetting resins, such as urea resins, phenolic resins, phenol-formaldehyde resins, melamine resins, urethane resins, unsaturated polyester resins, alkyd resins, and epoxy resins, and resins produced through the reaction of a curing agent with at least one resin selected from the group consisting of polyamide resins, polyester resins, polyether resins, methacrylic resins, acrylic resins, polyvinyl alcohol resins, and polyvinyl acetal resins.

In the case where two or more of these binder resins are used in combination, the mixture ratio is appropriately determined.

The undercoat layer may contain a variety of additives to enhance electric properties, environmental stability, and image quality.

Examples of the additives include known materials such as electron-transporting pigments (e.g., condensed polycyclic pigments and azo pigments), zirconium chelate compounds, titanium chelate compounds, aluminum chelate compounds, titanium alkoxide compounds, organic titanium compounds, and silane coupling agents. A silane coupling agent is used for the surface treatment of the metal oxide particles as described above; however, it may be further added, as an additive, to the undercoat layer.

Examples of the silane coupling agents as the additives include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octylene glycolate, ammonium salts of titanium lactate, titanium lactate, ethyl esters of titanium lactate, titanium triethanol aminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone or in the form of a mixture or polycondensate of multiple compounds.

The undercoat layer desirably has a Vickers hardness of 35 or more.

The surface roughness (ten-point average roughness) of the undercoat layer is desirably adjusted to be from ¼n (n is a refractive index of the upper layer) to ½ of the wavelength λ of laser light to be used for exposure in order to reduce Moire fringes.

The undercoat layer may contain, for example, resin particles in order to adjust the surface roughness. Examples of the resin particles include silicone resin particles and crosslinkable polymethyl methacrylate resin particles. The surface of the undercoat layer may be polished to adjust the surface roughness. Examples of a polishing technique include buff polishing, sandblasting, wet honing, and grinding.

The undercoat layer may be formed by any technique provided that the angular frequency ωmax and the volume resistivity can be controlled to be within the above-mentioned ranges; for instance, the above-mentioned components are added to a solvent to prepare a coating liquid for forming the undercoat layer, the coating liquid is used to form a coating film, and the coating film is dried and optionally heated.

An example of the coating liquid for forming the undercoat layer is suitably the above-mentioned undercoat-layer-forming coating liquid. In particular, it may be the undercoat-layer-forming coating liquid which is the mixture of the dispersion liquid X as the first undercoat-layer-forming coating liquid containing the first metal oxide particles and the dispersion liquid Y as the second undercoat-layer-forming coating liquid containing the second metal oxide particles and in which the first metal oxide particles have a smaller diameter than the second metal oxide particles.

Examples of the solvent used in the preparation of the coating liquid used for forming the undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples of such solvents include typical organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a technique for dispersing the metal oxide particles in the preparation of the coating liquid used for forming the undercoat layer include known techniques that involve use of a roll mill, a ball mill, a vibratory ball mill, an attritor, a sand mill, a colloid mill, or a paint shaker.

Examples of a technique for applying the coating liquid used for forming the undercoat layer onto the conductive substrate include typical techniques such as blade coating, wire bar coating, spray coating, dip coating, bead coating, air knife coating, and curtain coating.

The thickness of the undercoat layer is adjusted to be, for example, preferably 15 μm or more, more preferably from 20 μm to 50 μm, and further preferably from 20 μm to 35 μm in order to easily control the volume resistivity determined from the Cole-Cole plot analysis to be within the above-mentioned range.

Intermediate Layer

Although not illustrated, an intermediate layer may be further provided between the undercoat layer and the photosensitive layer.

An example of the intermediate layer is a layer containing resin. Examples of the resin used for forming the intermediate layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organic metal compound. Examples of the organic metal compound used for forming the intermediate layer include organic metal compounds containing metal atoms of zirconium, titanium, aluminum, manganese, or silicon.

These compounds used for forming the intermediate layer may be used alone or in the form of a mixture or polycondensate of multiple compounds.

In particular, the intermediate layer is suitably a layer containing an organic metal compound that contains a zirconium atom or a silicon atom.

The intermediate layer may be formed by any of known techniques; for instance, the above-mentioned components are added to a solvent to prepare a coating liquid used for forming the intermediate layer, the coating liquid is used to form a coating film, and the coating film is dried and optionally heated.

Examples of a technique for applying the coating liquid used for forming the intermediate layer include typical techniques such as dip coating, push-up coating, wire bar coating, spray coating, blade coating, knife coating, and curtain coating.

The thickness of the intermediate layer is suitably adjusted to be, for instance, from 0.1 μm to 3 μm. The intermediate layer may serve as the undercoat layer.

Charge-generating Layer

An example of the charge-generating layer is a layer containing a charge-generating material and a binder resin. The charge-generating layer may be a deposited layer of a charge-generating material. The deposited layer of a charge-generating material is suitable for the case in which an incoherent light source such as a light emitting diode (LED) or an organic electro-luminescence (EL) image array is used.

Examples of the charge-generating material include azo pigments such as bisazo pigments and trisazo pigments; fused ring aromatic pigments such as dibromoanthanthrone; perylene pigments; pyrrolopyrrole pigments; phthalocyanine pigments; zinc oxide; and trigonal selenium.

In particular, suitable charge-generating materials to enable exposure to laser light having a wavelength that is in a near infrared region are metal phthalocyanine pigments and metal-free phthalocyanine pigments. Specific examples thereof include hydroxygallium phthalocyanine, chlorogallium phthalocyanine, dichlorotin phthalocyanine, and titanyl phthalocyanine.

Suitable charge-generating materials to enable exposure to laser light having a wavelength that is in a near ultraviolet region are fused ring aromatic pigments such as dibromoanthanthrone, thioindigo pigments, porphyrazine compounds, zinc oxide, trigonal selenium, and bisazo pigments.

The above-mentioned charge-generating materials may be used also in the case where an incoherent light source such as an LED or organic EL image array having a central emission wavelength ranging from 450 nm to 780 nm is used; however, when the photosensitive layer has a thickness of 20 μm or less in terms of resolution, the field intensity in the photosensitive layer becomes high, which easily results in a decrease in the degree of charging due to electric charges injected from the substrate, namely the occurrence of image defects called black spots. This phenomenon is more likely to be caused in the case of using charge-generating materials that are p-type semiconductors and that easily generate dark current, such as trigonal selenium and a phthalocyanine pigment.

Use of charge-generating materials that are n-type semiconductors, such as fused ring aromatic pigments, perylene pigments, and azo pigments, is less likely to generate dark current and enables a reduction in the occurrence of image defects called black spots even at the reduced thickness of the photosensitive layer.

In order to distinguish an n-type charge-generating material, a time-of-flight technique that has been generally employed is used to analyze the polarity of flowing photoelectric current, and a material in which electrons are likely to flow as carriers rather than holes is determined as an n-type charge-generating material.

The binder resin used for forming the charge-generating layer is selected from a variety of insulating resins and may be selected from organic photoconductive polymers such as poly-N-vinylcarbazole, polyvinyl anthracene, polyvinyl pyrene, and polysilane.

Examples of the binder resin include polyvinyl butyral resins, polyarylate resins (such as a polycondensate made from a bisphenol and an aromatic divalent carboxylic acid), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" herein refers to a volume resistivity of $10^{13}$ Ωm or more.

These binder resins may be used alone or in combination.

The mixture ratio of the charge-generating material to the binder resin is suitably from 10:1 to 1:10 on a weight basis.

The charge-generating layer may further contain a known additive.

The charge-generating layer may be formed by any of known techniques; for instance, the above-mentioned components are added to a solvent to prepare a coating liquid used for forming the charge-generating layer, the coating liquid is used to form a coating film, and the coating film is dried and optionally heated. The charge-generating layer may be formed by depositing the charge-generating material. Such formation of the charge-generating layer by deposition is suitable particularly in the case of using a fused ring aromatic pigment or a perylene pigment as the charge-generating material.

Examples of the solvent used in the preparation of the coating liquid used for forming the charge-generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in combination.

Particles (e.g., charge-generating material) are, for example, dispersed in the coating liquid used for forming the charge-generating layer with a disperser involving use of media, such as a ball mill, a vibratory ball mill, an attritor, a sand mill, or horizontal sand mill, or with a media-free disperser such as a stirrer, an ultrasonic disperser, a roll mill, and a high-pressure homogenizer. Examples of the high-pressure homogenizer include an impact-type homogenizer in which a highly pressurized dispersion liquid is allowed to collide with another liquid or a wall for dispersion and a through-type homogenizer in which a highly pressurized dispersion liquid is allowed to flow through a fine flow channel for dispersion.

In this dispersion procedure, it is effective that the average particle size of the charge-generating material used in the coating liquid for forming the charge-generating layer is 0.5 μm or less, preferably 0.3 μm or less, and more preferably 0.15 μm or less.

Examples of a technique for applying the coating liquid used for forming the charge-generating layer onto the undercoat layer (or intermediate layer) include typical techniques such as blade coating, wire bar coating, spray coating, dip coating, bead coating, air knife coating, and curtain coating.

The thickness of the charge-generating layer is, for example, adjusted to be suitably from 0.1 μm to 5.0 μm, and preferably from 0.2 μm to 2.0 μm.

Charge-transporting Layer

An example of the charge-transporting layer is a layer containing a charge-transporting material and a binder resin. The charge-transporting layer may be a layer containing a charge-transporting polymeric material.

Examples of the charge-transporting material include electron-transporting compounds, e.g., quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge-transporting material include hole-transporting compounds such as triarylamine compounds, benzidine compounds, arylalkane compounds, aryl-substituted ethylene compounds, stilbene compounds, anthracene compounds, and hydrazone compounds. These charge-transporting materials are used alone or in combination but not limited thereto.

The charge-transporting material is suitably any of triarylamine derivatives represented by Structural Formula (a-1) or any of benzidine derivatives represented by Structural Formula (a-2) in terms of charge mobility.

(a-1)

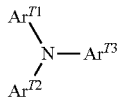

In Structural Formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent of each of these groups include a halogen atom, an alkyl group having from 1 to 5 carbon atoms, and an alkoxy group having from 1 to 5 carbon atoms. Another example of the substituent is a substituted amino group that is substituted with an alkyl group having from 1 to 3 carbon atoms.

(a-2)

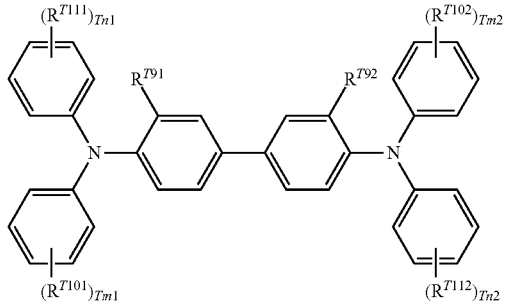

In Structural Formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms. $R^{T101}$, $R^{T102}$, $R^{T111}$, and $R^{T112}$ each independently represent a halogen atom, an alkyl group having from 1 to 5 carbon atoms, an alkoxy group having from 1 to 5 carbon atoms, an amino group substituted with an alkyl group having from 1 or 2 carbon atoms, a substituted or unsubstituted aryl group, $—C(R^{T12})=C(R^{T13})(R^{T14})$) or $—CH=CH—CH=C(R^{T15})(R^{T16})$; $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer from 0 to 2.

Examples of the substituent of each of these groups include a halogen atom, an alkyl group having from 1 to 5 carbon atoms, and an alkoxy group having from 1 to 5 carbon atoms. Another example of the substituent is a substituted amino group that is substituted with an alkyl group having from 1 to 3 carbon atoms.

Among the triarylamine derivatives represented by Structural Formula (a-1) and the benzidine derivatives represented by Structural Formula (a-2), a triarylamine derivative having a part "$—C_6H_4—CH=CH—CH=C(R^{T7})(R^{T8})$" and a benzidine derivative having a part "$—CH=CH—CH=C(R^{T15})(R^{T16})$" are suitable in terms of charge mobility.

Examples of the charge-transporting polymeric material include known materials having a charge transportability, such as poly-N-vinylcarbazole and polysilane. In particular, charge-transporting polymeric materials involving polyester are suitable. The charge-transporting polymeric material may be used alone or in combination with a binder resin.

Examples of the binder resin used in the charge-transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins and polyarylate resins are suitably used as the binder resin. These binder resins are used alone or in combination.

The mixing ratio of the charge-transporting material to the binder resin is suitably from 10:1 to 1:5 on a weight basis.

The charge-transporting layer may further contain a known additive.

The charge-transporting layer may be formed by any of known techniques; for instance, the above-mentioned components are added to a solvent to prepare a coating liquid used for forming the charge-transporting layer, the coating liquid is used to form a coating film, and the coating film is dried and optionally heated.

Examples of the solvent used in the preparation of the coating liquid used for forming the charge-transporting layer include typical organic solvents, e.g., aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or straight-chain ethers such as tetrahydrofuran and ethyl ether. These solvents are used alone or in combination.

Examples of a technique for applying the coating liquid used for forming the charge-transporting layer onto the charge-generating layer include typical techniques such as blade coating, wire bar coating, spray coating, dip coating, bead coating, air knife coating, and curtain coating.

The thickness of the charge-transporting layer is, for instance, adjusted to be preferably from 5 μm to 50 μm, and more preferably from 10 μm to 30 μm.

Protective Layer

The protective layer is optionally formed on the photosensitive layer. The protective layer is formed, for instance, in order to prevent the photosensitive layer from being chemically changed in the charging and to improve the mechanical strength of the photosensitive layer.

Hence, the protective layer is properly a layer of a cured film (crosslinked film). Examples of such a layer include the following layers (1) and (2).

(1) Layer of a cured film made of a composition that contains a reactive-group-containing charge-transporting material of which one molecule has both a reactive group and a charge-transporting skeleton (in other words, layer containing a polymer or crosslinked product of the reactive-group-containing charge-transporting material)

(2) Layer of a cured film made of a composition that contains a nonreactive charge-transporting material and a reactive-group-containing non-charge-transporting material that does not have a charge-transporting skeleton but has a reactive group (in other words, layer containing polymers or crosslinked products of the nonreactive charge-transporting material and reactive-group-containing non-charge-transporting material)

Examples of the reactive group of the reactive-group-containing charge-transporting material include known reactive groups such as a chain polymerizable group, an epoxy group, —OH, —OR (where R represents an alkyl group), $—NH_2$, —SH, —COOH, and $—SiR^{Q1}{}_{3-Qn}(OR^{Q2})_{Qn}$ (where $R^{Q1}$ represents a hydrogen atom, an alkyl group, or a substituted or unsubstituted aryl group; $R^{Q2}$ represents a hydrogen atom, an alkyl group, or a trialkylsilyl group; and Qn represents an integer from 1 to 3).

Any chain polymerizable group may be employed provided that it is a functional group that enables a radical polymerization; for example, a functional group at least having a group with a carbon double bond may be employed. Specific examples thereof include groups containing at least one selected from a vinyl group, a vinyl ether group, a vinyl thioether group, a styryl group (vinylphenyl group), an acryloyl group, a methacryloyl group, and derivatives thereof. Among these, suitable chain polymerizable groups are groups containing at least one selected from a vinyl group, a styryl group (vinylphenyl group), an acryloyl group, a methacryloyl group, and derivatives thereof because they have excellent reactivity.

The charge-transporting skeleton of the reactive-group-containing charge-transporting material is not particularly limited provided that it is a known structure in the field of electrophotographic photoreceptors. Examples of such a structure include skeletons that are derived from nitrogen-containing hole-transporting compounds, such as triarylamine compounds, benzidine compounds, and hydrazone compounds, and that are conjugated with a nitrogen atom. In particular, triarylamine skeletons are suitable.

The reactive-group-containing charge-transporting material having both a reactive group and a charge-transporting skeleton, the nonreactive charge-transporting material, and the reactive-group-containing non-charge transporting material may be selected from known materials.

The protective layer may further contain a known additive.

The protective layer may be formed by any of known techniques; for instance, the above-mentioned components are added to a solvent to prepare a coating liquid used for forming the protective layer, the coating liquid is used to form a coating film, and the coating film is dried and optionally heated for curing.

Examples of the solvent used in the preparation of the coating liquid used for forming the protective layer include aromatic hydrocarbon solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents are used alone or in combination.

The coating liquid used for forming the protective layer may be a solventless coating liquid.

Examples of a technique for applying the coating liquid used for forming the protective layer onto the photosensitive layer (e.g., charge-transporting layer) include typical techniques such as dip coating, push-up coating, wire bar coating, spray coating, blade coating, knife coating, and curtain coating.

The thickness of the protective layer is, for instance, adjusted to be preferably from 1 μm to 20 μm, and more preferably from 2 μm to 10 μm.

Single Photosensitive Layer

The single photosensitive layer (charge-generating/charge-transporting layer) is, for example, a layer containing a charge-generating material, a charge-transporting material, and optionally a binder resin and another known additive. These materials are the same as those described as the materials used for forming the charge-generating layer and the charge-transporting layer.

The amount of the charge-generating material contained in the single photosensitive layer is suitably from 10 weight % to 85 weight %, and preferably from 20 weight % to 50 weight % relative to the total solid content. The amount of the charge-transporting material contained in the single photosensitive layer is suitably from 5 weight % to 50 weight % relative to the total solid content.

The single photosensitive layer is formed by the same technique as those for forming the charge-generating layer and the charge-transporting layer.

The thickness of the single photosensitive layer is, for instance, suitably from 5 μm to 50 μm, and preferably from 10 μm to 40 μm.

Image Forming Apparatus (and Process Cartridge)

An image forming apparatus according to a second exemplary embodiment includes an electrophotographic photoreceptor, a charging unit that serves to charge the surface of the electrophotographic photoreceptor, an electrostatic latent image forming unit that serves to form an electrostatic latent image on the surface of the charged electrophotographic photoreceptor, a developing unit that serves to develop the electrostatic latent image on the surface of the electrophotographic photoreceptor with a developer containing toner to form a toner image, and a transfer unit that serves to transfer the toner image to the surface of a recording medium. The electrophotographic photoreceptor is the electrophotographic photoreceptor according to the first exemplary embodiment.

The image forming apparatus according to the second exemplary embodiment may be any of the following known image forming apparatuses: an apparatus which has a fixing unit that serves to fix the toner image transferred to the surface of a recording medium, a direct-transfer-type apparatus in which the toner image formed on the surface of the electrophotographic photoreceptor is directly transferred to a recording medium, an intermediate-transfer-type apparatus in which the toner image formed on the surface of the electrophotographic photoreceptor is subjected to first transfer to the surface of an intermediate transfer body and in which the toner image transferred to the surface of the intermediate transfer body is then subjected to second transfer to the surface of a recording medium, an apparatus which has a cleaning unit that serves to clean the surface of the electrophotographic photoreceptor after the transfer of a toner image and before the charging of the electrophotographic photoreceptor, an apparatus which has an erasing unit that serves to radiate light to the surface of the electrophotographic photoreceptor for removal of charges after the transfer of a toner image and before the charging of the electrophotographic photoreceptor, and an apparatus which has an electrophotographic photoreceptor heating unit that serves to heat the electrophotographic photoreceptor to decrease the relative temperature.

In the intermediate-transfer-type apparatus, the transfer unit, for example, includes an intermediate transfer body of which a toner image is to be transferred to the surface, a first transfer unit which serves for first transfer of the toner image formed on the surface of the electrophotographic photoreceptor to the surface of the intermediate transfer body, and a second transfer unit which serves for second transfer of the toner image transferred to the surface of the intermediate transfer body to the surface of a recording medium.

The image forming apparatus according to the second exemplary embodiment may be either of a dry development type and a wet development type (development with a liquid developer is performed).

In the structure of the image forming apparatus according to the second exemplary embodiment, for instance, the part that includes the electrophotographic photoreceptor may be in the form of a cartridge that is removably attached to the image forming apparatus (process cartridge). A suitable example of the process cartridge to be used is a process cartridge including the electrophotographic photoreceptor according to the first exemplary embodiment. The process cartridge may include, in addition to the electrophotographic photoreceptor, at least one selected from the group consisting of, for example, the charging unit, the electrostatic latent image forming unit, the developing unit, and the transfer unit.

An example of the image forming apparatus according to the second exemplary embodiment will now be described; however, the image forming apparatus according to the second exemplary embodiment is not limited thereto. The parts shown in the drawings are described, while description of the other parts is omitted.

Figure 6:
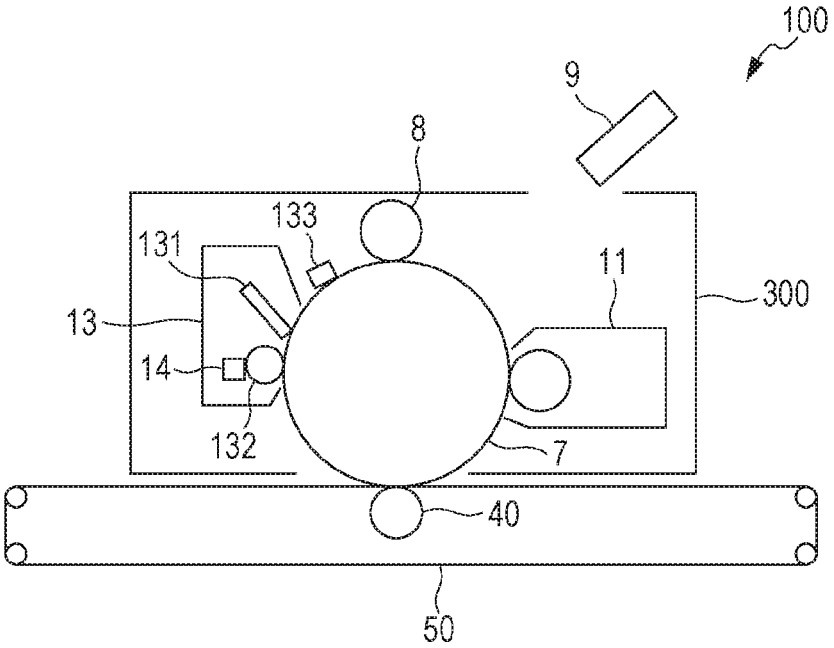
FIG. 6 schematically illustrates the structure of an image forming apparatus according to a second exemplary embodiment.

FIG. 6 schematically illustrates an example of the structure of the image forming apparatus according to the second exemplary embodiment.

As illustrated in FIG. 6, an image forming apparatus 100 according to the second exemplary embodiment includes a process cartridge 300 having an electrophotographic photoreceptor 7, an exposure device 9 (example of the electrostatic latent image forming unit), a transfer device 40 (first transfer unit), and an intermediate transfer body 50. In the image forming apparatus 100, the exposure device 9 is disposed such that the electrophotographic photoreceptor 7 can be irradiated with light through the opening of the process cartridge 300, the transfer unit 40 is disposed so as to face the electrophotographic photoreceptor 7 with the intermediate body 50 interposed therebetween, and the intermediate body 50 is placed such that part thereof is in contact with the electrophotographic photoreceptor 7. Although not illustrated, the image forming apparatus also includes a second transfer device that serves to transfer a toner image transferred to the intermediate transfer body 50 to a recording medium (e.g., paper). In this case, the intermediate transfer body 50, the transfer device 40 (first transfer device), and the second transfer device (not illustrated) are an example of the transfer unit.

In the process cartridge 300 illustrated in FIG. 6, a housing integrally accommodates the electrophotographic photoreceptor 7, the charging device 8 (example of the charging unit), the developing device 11 (example of the developing unit), and the cleaning device 13 (example of the cleaning unit). The cleaning device 13 has a cleaning blade 131 (example of a cleaning member), and the cleaning blade 131 is disposed so as to be in contact with the surface of the electrophotographic photoreceptor 7. The cleaning member does not need to be in the form of the cleaning blade 131 but may be a conductive or insulating fibrous member; this fibrous member may be used alone or in combination with the cleaning blade 131.

The example of the image forming apparatus in FIG. 6 includes a fibrous member 132 (roll) that serves to supply a lubricant 14 to the surface of the electrophotographic photoreceptor 7 and a fibrous member 133 (flat brush) that supports the cleaning, and these members are optionally placed.

Each part of the image forming apparatus according to the second exemplary embodiment will now be described.

Charging Device

Examples of the charging device 8 includes contact-type chargers that involve use of a conductive or semi-conductive charging roller, charging brush, charging film, charging rubber blade, or charging tube. Any of other known chargers may be used, such as a non-contact-type roller charger and a scorotron or coroton charger in which corona discharge is utilized.

Exposure Device

Examples of the exposure device 9 include optical systems that expose the surface of the electrophotographic photoreceptor 7 to light, such as light emitted from a semiconductor laser, an LED, or a liquid crystal shutter, in the shape of the intended image. The wavelength of light source is within the spectral sensitivity of the electrophotographic photoreceptor. The light from a semiconductor laser is generally near-infrared light having an oscillation wavelength near 780 nm. The wavelength of the light is, however, not limited thereto; laser light having an oscillation wavelength of the order of 600 nm or blue laser light having an oscillation wavelength ranging from 400 nm to 450 nm may be employed. A surface-emitting laser source that can emit multiple beams is also effective for formation of color images.

Developing Device

Examples of the developing device 11 is general developing devices that develop images through contact or non-contact with a developer. The developing device 11 is not particularly limited provided that it has the above-mentioned function, and a proper structure for the intended use is selected. An example of the developing device 11 is a known developing device that serves to attach a one-component or two-component developer to the electrophotographic photoreceptor 7 with a brush or a roller. In particular, a developing device including a developing roller of which the surface holds a developer is suitable.

The developer used in the developing device 11 may be either of a one-component developer of toner alone and a two-component developer containing toner and a carrier. The developer may be either magnetic or nonmagnetic. Any of known developers may be used.

Cleaning Device

The cleaning device 13 is a cleaning-blade type in which the cleaning blade 131 is used.

The cleaning device 13 may have a structure other than the cleaning-blade type; in particular, fur brush cleaning may be employed, or the cleaning may be performed at the same time as the developing.

Transfer Device

Examples of the transfer device 40 include known transfer chargers such as contact-type transfer chargers having a belt, a roller, a film, or a rubber blade and non-contact-type transfer chargers in which corona discharge is utilized, e.g., a scorotron transfer charger and a corotron transfer charger.

Intermediate Transfer Body

The intermediate transfer body 50 is, for instance, in the form of a belt (intermediate transfer belt) containing a semi-conductive polyimide, polyamide imide, polycarbonate, polyarylate, polyester, or rubber. The intermediate transfer body may be in the form other than a belt, such as a drum.

Figure 7:
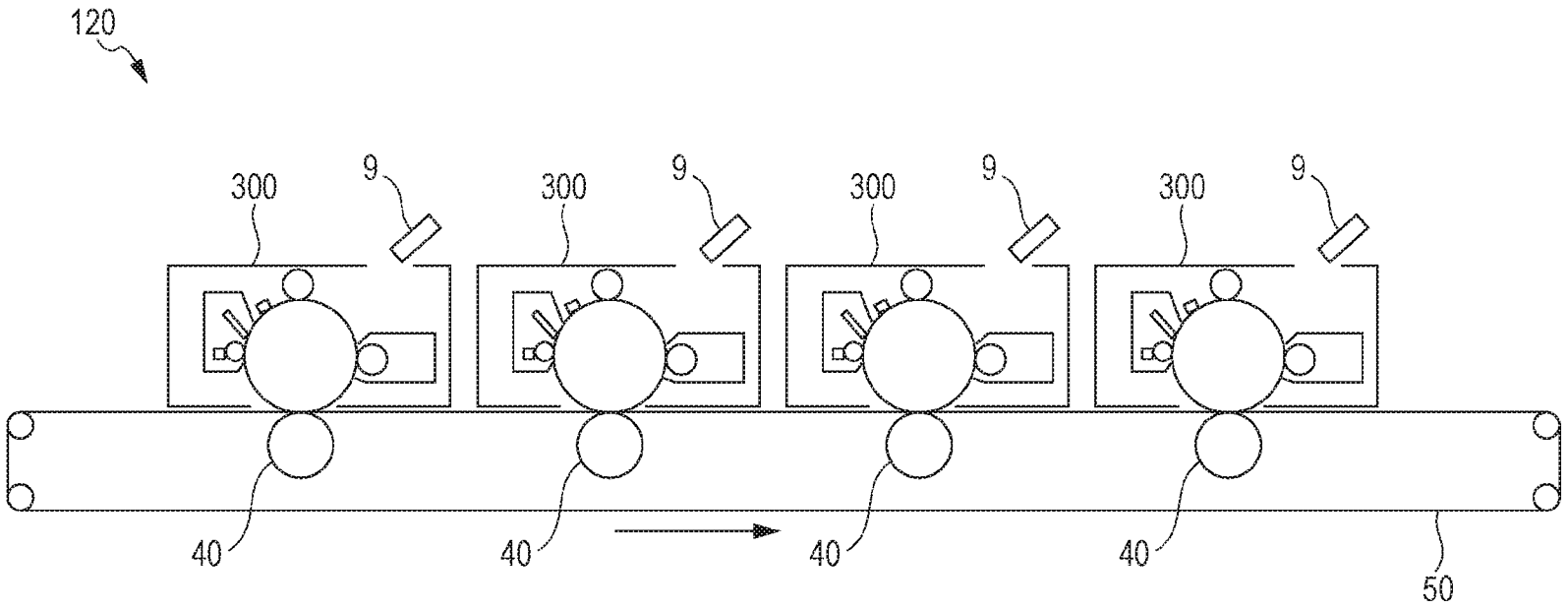
FIG. 7 schematically illustrates the structure of another image forming apparatus according to the second exemplary embodiment.

FIG. 7 schematically illustrates another example of the structure of the image forming apparatus according to the second exemplary embodiment.

An image forming apparatus 120 illustrated in FIG. 7 is a tandem-type multicolor image forming apparatus including four process cartridges 300. In the image forming apparatus 120, the four process cartridges 300 are disposed in parallel so as to overlie the intermediate transfer body 50, and one electrophotographic photoreceptor serves for one color. Except that the image forming apparatus 120 is a tandem type, it has the same structure as the image forming apparatus 100.

The structure of the image forming apparatus 100 of the second exemplary embodiment is not limited to the above-mentioned structure. For instance, a first charge-neutralizing device that makes residual toner have the same polarity to easily remove the residual toner with a cleaning brush may be provided around the electrophotographic photoreceptor 7 downstream of the transfer device 40 and upstream of the cleaning device 13 in the rotational direction of the electrophotographic photoreceptor 7. Furthermore, a second charge-neutralizing unit that neutralizes the charge on the surface of the electrophotographic photoreceptor 7 may be provided downstream of the cleaning device 13 and upstream of the charging device 8 in the rotational direction of the electrophotographic photoreceptor 7.

The structure of the image forming apparatus 100 of the second exemplary embodiment is not limited to the above-mentioned structure and may have a known structure; for instance, a direct transfer system may be employed, in which a toner image formed on the electrophotographic photoreceptor 7 is directly transferred to a recording medium.

EXAMPLES

Exemplary embodiments of the invention will now be described in detail with reference to Examples but are not limited thereto. In the following description, the terms "part" and "%" are on a weight basis unless otherwise specified. The term "wt %" refers to weight %.

Preparation of Undercoat-layer-forming Dispersion Liquid A

With 100 parts by weight of zinc oxide particles (trade name: MZ-300, manufactured by TAYCA CORPORATION), 10 parts by weight of N-β(aminoethyl)γ-aminopropyltriethoxysilane as a silane coupling agent (10 weight % of toluene solution) and 200 parts by weight of toluene are mixed. Then, the mixture is stirred and subsequently refluxed for 2 hours. The toluene is distilled off under reduced pressure at 10 mmHg, and the resulting product is baked at 135° C. for 2 hours for surface treatment.

Then, 33 parts by weight of the surface-treated zinc oxide particles are mixed with 6 parts by weight of blocked isocyanate (trade name: SUMIDUR 3175, manufactured by Sumitomo Bayer Urethane Co., Ltd.) and 25 parts by weight of methyl ethyl ketone, and the mixture is subjected to dispersion for 30 minutes. Then, 5 parts by weight of a butyral resin (trade name: S-LEC BM-1, manufactured by SEKISUI CHEMICAL CO., LTD.), 1 part by weight of a compound represented by Formula (X) {compound having an anthraquinone structure with a hydroxy group, corresponding to the exemplary compound (1-9)}, 3 parts by weight of silicone balls (trade name: TOSPEARL 120 manufactured by Momentive Performance Materials Inc.), and 0.01 part by weight of a leveling agent that is a silicone oil (trade name: SH29PA, manufactured by Dow Corning Toray Silicone Co., Ltd.) are added to the mixture. The resulting mixture is subjected to dispersion with a sand mill for 8 hours to yield an undercoat-layer-forming dispersion liquid (also referred to as "dispersion liquid") A.

Formula (X)

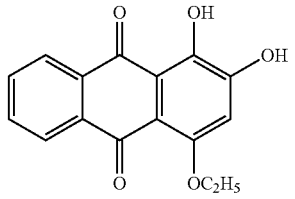

Preparation of Undercoat-layer-forming Dispersion Liquid B

A dispersion liquid B is prepared as in the preparation of the dispersion liquid A except that the period of the dispersion time with a sand mill is changed to 4 hours.

Preparation of Undercoat-layer-forming Dispersion Liquid C

A dispersion liquid C is prepared as in the preparation of the dispersion liquid A except that the amount of the zinc oxide particles is changed to 30 parts by weight.

Preparation of Undercoat-layer-forming Dispersion Liquid D

A dispersion liquid D is prepared as in the preparation of the dispersion liquid A except that the amount of the zinc oxide particles is changed to 30 parts by weight and that the period of the dispersion time with a sand mill is changed to 4 hours.

Example 1

Formation of Undercoat Layer

An aluminum substrate (IP tube) produced by impact pressing and having a diameter of 30 mm, a length of 252.9 mm, and a thickness of 0.50 mm is prepared as a conductive substrate.

Then, 24 parts by weight of the dispersion liquid A and 76 parts by weight of the dispersion liquid B are mixed with each other to produce an undercoat-layer-forming coating liquid.

The undercoat-layer-forming coating liquid is applied to the aluminum substrate by dip coating and then dried and cured at 180° C. for 30 minutes to form an undercoat layer having a thickness of 23.5 μm.

Formation of Charge-generating Layer

With 18 parts by weight of a hydroxygallium phthalocyanine pigment as a charge-generating material, 16 parts by weight of a vinyl chloride-vinyl acetate copolymer resin (trade name: VMCH, manufactured by Nippon Unicar Company Limited) as a binder resin and 100 parts by weight of n-butyl acetate are mixed. This mixture is put into a glass bottle having a capacity of 100 mL, and glass beads having a diameter of 1.0 mm are also put thereinto at a filling rate of 50%. The content is mixed and then subjected to dispersion with a paint shaker for 2.5 hours to produce a coating liquid for forming a charge-generating layer. The coating liquid for forming a charge-generating layer is applied to the undercoat layer produced as describe above by dip coating and dried at 100° C. for 5 minutes to form a charge-generating layer having a thickness of 0.20 μm.

Formation of Charge-transporting Layer

To 60 parts by weight of tetrahydrofuran, 2 parts by weight of a compound represented by Formula (a-1A), 2 parts by weight of a compound represented by Formula (a-2A), and 6 parts by weight of a bisphenol Z polycarbonate resin (molecular weight of 40,000) are added and dissolved, thereby producing a coating liquid for forming a charge-transporting layer. The coating liquid for forming a charge-transporting layer is applied to the charge-generating layer formed as described above and dried at 150° C. for 30 minutes to form a charge-transporting layer having a thickness of 26 μm. Through these processes, a photoreceptor has been produced.

(a-1A)

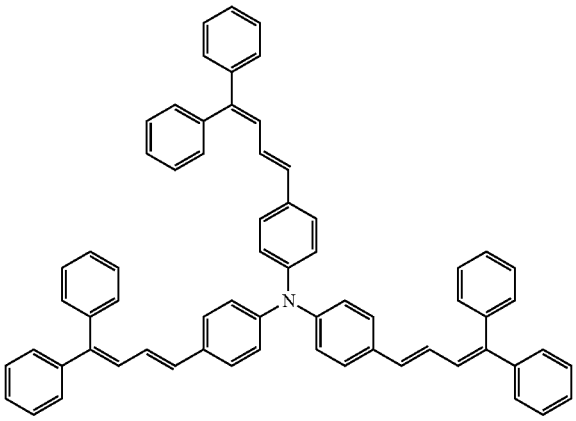

(a-2A)

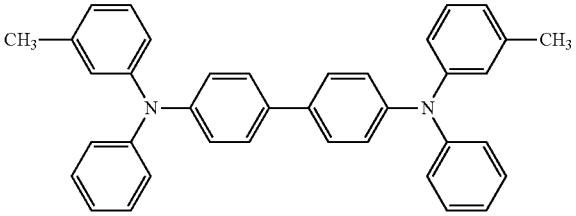

Examples 2 to 20

Photoreceptors are produced as in Example 1 except that the type of the aluminum substrate, the types and amounts of the dispersion liquids, and the thickness of the undercoat layer are changed as shown in Table 1.

Comparative Examples 1 to 20

Photoreceptors are produced as in Example 1 except that the type of the aluminum substrate, the types and amounts of the dispersion liquids, and the thickness of the undercoat layer are changed as shown in Table 2.

Evaluations

Measurement of Width and Depth of Largest Depression {Condition (A)}

In the production of the photoreceptor of each Example, depressions existing in the surface of the aluminum substrate are observed with a laser microscope before the formation of the undercoat layer, and the width and depth of the largest depression are measured in the manner described above. The position of the depression is recorded so that it can be recognized after the formation of the undercoat layer on the aluminum substrate. Tables 1 and 2 show results of the measurements of the width and depth of the largest depression.

Measurement of Angular Frequency ωmax {Condition (B)} and Volume Resistivity {Condition (C)}

In the production of the photoreceptor of each Example, the aluminum substrate having the undercoat layer is used to determine volume resistivity and the angular frequency ωmax that gives the maximum complex impedance component (imaginary component Z" of impedance Z).

A circular metal electrode having a diameter of 6 millimeters and a thickness of 300 angstroms is formed by ion sputtering at the center of the undercoat layer on the aluminum substrate in the axial direction. Then, the angular frequency ωmax and volume resistivity of the undercoat layer are determined in the manner described above. The measurement is carried out under the following conditions. Tables 1 and 2 show results of the measurements.

Measurement Conditions

Direct current voltage applied: 0 V

Alternating-current voltage applied: 1.0 V

Sweep frequency: 1.0 MHz to 1.0 mHz

Number of measurement steps: 5 pts/decade

Evaluation of Image Quality

The electrophotographic photoreceptors produced in Examples are individually attached to an electrophotographic image forming apparatus (DocuPrint P450d manufactured by Fuji Xerox Co., Ltd.) to evaluate image quality.

A sheet of A4 paper of which a half-tone image has been formed on the whole area at an image density of 30% is output to evaluate defective image quality (white spots) that occurs at positions corresponding to the recorded positions of the depressions having the largest width and the largest depth in the surface of the aluminum substrate (conductive substrate); in addition, the image density of the image formed on the whole area is also evaluated (evaluation of initial image quality). Then, 10,000 sheets of A4 paper of which a half-tone image has been formed on the whole areas at an image density of 30% are sequentially output to similarly evaluate the image density of the image formed on the 10,000th paper (evaluation of image quality after output of 10,000 sheets of paper).

The defective image quality (white spots) and the image density of an image formed on the whole area of paper are visually observed to be evaluated. The evaluation of the defective image quality (white spots) is on the basis of six grades from G0 to G5, one by one; the smaller the number appended to "G" is, the better the evaluation result is {in particular, the evaluation becomes bad as the grade goes from G0 to G5, such as G0 (good)>G1>G2>G3>G4>G5 (bad)}. In the evaluation of defective image quality (white spots), grades of G3 or better are acceptable.

In the case where a depression having the largest width is different from a depression having the largest depth, results produced at the positions of the two depressions are compared, and the worse one is employed. Tables 1 and 2 show results of the evaluation.

Evaluation Criteria of Defective Image Quality (Whit Spots)

G0: No defective image quality is observed

G1: Almost no defective image quality is observed

G2: Slight defective image quality is observed

G3: Some defective image quality is observed

G4: Apparent defective image quality is observed

G5: Large degree of apparent defective image quality is observed

TABLE 1

| | Conductive substrate | | | Undercoat layer | | | | |
|---|---|---|---|---|---|---|---|---|
| | | Condition (A) | | | | | | Condition (C) |
| | | Largest | Largest | Dispersion liquid for forming undercoat layer | | | | |
| | Type | width of depression (μm) | depth of depression (μm) | Dispersion liquid (A) (wt %) | Dispersion liquid (B) (wt %) | Dispersion liquid (C) (wt %) | Dispersion liquid (D) (wt %) | Volume Resistivity (Ω) |
| Example 1 | IP tube | 12.3 | 3.8 | 24 | 76 | 0 | 0 | $7.1 \times 10^7$ |
| Example 2 | IP tube | 138.5 | 5.2 | 40 | 60 | 0 | 0 | $8.2 \times 10^7$ |
| Example 3 | IP tube | 229.6 | 7.8 | 36 | 64 | 0 | 0 | $8.5 \times 10^7$ |
| Example 4 | IP tube | 298.1 | 11.2 | 58 | 42 | 0 | 0 | $2.2 \times 10^8$ |
| Example 5 | IP tube | 303.5 | 10.3 | 84 | 16 | 0 | 0 | $3.2 \times 10^8$ |
| Example 6 | IP tube | 335.4 | 12.4 | 96 | 4 | 0 | 0 | $1.1 \times 10^8$ |
| Example 7 | IP tube | 348.9 | 11.9 | 80 | 20 | 0 | 0 | $1.8 \times 10^8$ |
| Example 8 | IP tube | 351.2 | 13.5 | 75 | 25 | 0 | 0 | $9.8 \times 10^7$ |
| Example 9 | IP tube | 375.6 | 14.2 | 71 | 29 | 0 | 0 | $1.0 \times 10^8$ |
| Example 10 | IP tube | 376.6 | 13.9 | 75 | 25 | 0 | 0 | $1.9 \times 10^8$ |
| Example 11 | IP tube | 388.2 | 14.2 | 75 | 25 | 0 | 0 | $1.7 \times 10^8$ |
| Example 12 | IP tube | 398.9 | 14.3 | 0 | 0 | 12 | 88 | $8.3 \times 10^7$ |
| Example 13 | IP tube | 388.8 | 13.9 | 0 | 0 | 16 | 84 | $9.8 \times 10^7$ |
| Example 14 | IP tube | 378.8 | 12.6 | 0 | 0 | 38 | 62 | $1.3 \times 10^8$ |
| Example 15 | IP tube | 395.6 | 14.1 | 0 | 0 | 90 | 10 | $2.9 \times 10^8$ |
| Example 16 | IP tube | 380.2 | 13.8 | 0 | 0 | 96 | 4 | $7.8 \times 10^8$ |
| Example 17 | IP tube | 387.3 | 14.2 | 0 | 0 | 98 | 2 | $8.9 \times 10^8$ |
| Example 18 | IP tube | 388.0 | 13.3 | 0 | 0 | 99 | 1 | $9.8 \times 10^8$ |
| Example 19 | ED tube | 382.3 | 12.6 | 0 | 0 | 99 | 1 | $9.8 \times 10^8$ |
| Example 20 | ED tube | 362.3 | 14.5 | 0 | 0 | 99 | 1 | $9.8 \times 10^8$ |

| | Undercoat layer | | Evaluations | | | |
|---|---|---|---|---|---|---|
| | Condition (B) Angular | | Evaluation of initial image quality | | Evaluation of image quality after output of 10,000 sheets | |
| | Frequency ωmax (Rad) | Thickness (μm) | Density of output image | Defective Image quality (white spots) | Density of output image | Defective Image quality (white spots) |
| Example 1 | 24.9 | 23.5 | Good | G0 | Good | G0 |
| Example 2 | 21.5 | 23.4 | Good | G0 | Good | G0 |
| Example 3 | 22.3 | 23.6 | Good | G0 | Good | G0 |
| Example 4 | 17.9 | 23.5 | Good | G0 | Good | G0 |
| Example 5 | 12.3 | 23.6 | Good | G0 | Good | G0 |
| Example 6 | 9.8 | 24.6 | Good | G1 | Good | G0 |
| Example 7 | 13.2 | 23.0 | Good | G1 | Good | G0 |
| Example 8 | 14.3 | 23.0 | Good | G1 | Good | G1 |
| Example 9 | 15.0 | 23.5 | Good | G2 | Good | G2 |
| Example 10 | 14.3 | 23.2 | Good | G2 | Good | G2 |
| Example 11 | 14.3 | 23.8 | Good | G3 | Good | G3 |
| Example 12 | 22.3 | 24.2 | Good | G0 | Good | G0 |
| Example 13 | 21.3 | 23.6 | Good | G0 | Good | G0 |
| Example 14 | 16.2 | 23.5 | Good | G0 | Good | G0 |
| Example 15 | 4.3 | 24.5 | Good | G0 | Good | G0 |
| Example 16 | 2.8 | 23.5 | Good | G0 | Good | G0 |
| Example 17 | 2.2 | 23.5 | Good | G0 | Good | G0 |
| Example 18 | 2.1 | 23.5 | Good | G0 | Good | G0 |
| Example 19 | 2.1 | 23.5 | Good | G0 | Good | G0 |
| Example 20 | 2.1 | 23.5 | Good | G0 | Good | G0 |

TABLE 2

| | Conductive substrate | | | Undercoat layer | | | | |
|---|---|---|---|---|---|---|---|---|
| | | Condition (A) | | | | | | Condition (C) |
| | | Largest | Largest | Dispersion liquid for forming undercoat layer | | | | |
| | Type | width of depression (μm) | depth of depression (μm) | Dispersion liquid (A) (wt %) | Dispersion liquid (B) (wt %) | Dispersion liquid (C) (wt %) | Dispersion liquid (D) (wt %) | Volume Resistivity (Ω) |
| Comparative Example 1 | IP tube | 401.2 | 13.9 | 88 | 12 | 0 | 0 | $1.1 \times 10^8$ |
| Comparative Example 2 | IP tube | 412.5 | 14.1 | 85 | 15 | 0 | 0 | $1.5 \times 10^8$ |
| Comparative Example 3 | IP tube | 420.6 | 14.8 | 91 | 9 | 0 | 0 | $1.9 \times 10^8$ |

TABLE 2-continued

| | | | | | | | | |
|---|---|---|---|---|---|---|---|---|
| Comparative Example 4 | IP tube | 422.2 | 14.6 | 93 | 7 | 0 | 0 | $1.7 \times 10^8$ |
| Comparative Example 5 | IP tube | 395.6 | 15.2 | 65 | 35 | 0 | 0 | $8.2 \times 10^7$ |
| Comparative Example 6 | IP tube | 398.2 | 15.9 | 80 | 20 | 0 | 0 | $1.2 \times 10^8$ |
| Comparative Example 7 | IP tube | 389.5 | 16.4 | 0 | 0 | 76 | 24 | $2.3 \times 10^8$ |
| Comparative Example 8 | IP tube | 392.2 | 17.3 | 0 | 0 | 80 | 20 | $2.1 \times 10^8$ |
| Comparative Example 9 | IP tube | 387.5 | 12.8 | 29 | 71 | 0 | 0 | $6.8 \times 10^7$ |
| Comparative Example 10 | IP tube | 388.2 | 12.4 | 29 | 71 | 0 | 0 | $5.1 \times 10^7$ |
| Comparative Example 11 | IP tube | 379.6 | 13.1 | 28 | 72 | 0 | 0 | $3.1 \times 10^7$ |
| Comparative Example 12 | IP tube | 366.5 | 13.1 | 0 | 0 | 97 | 3 | $1.1 \times 10^9$ |
| Comparative Example 13 | IP tube | 379.7 | 13.5 | 0 | 0 | 98 | 2 | $2.3 \times 10^9$ |
| Comparative Example 14 | IP tube | 381.2 | 13.4 | 0 | 0 | 99 | 1 | $8.6 \times 10^9$ |
| Comparative Example 15 | IP tube | 365.6 | 14.2 | 0 | 0 | 99.5 | 0.5 | $8.9 \times 10^8$ |
| Comparative Example 16 | IP tube | 374.5 | 14.2 | 0 | 0 | 99.6 | 0.4 | $7.3 \times 10^8$ |
| Comparative Example 17 | IP tube | 379.6 | 12.9 | 0 | 0 | 99.7 | 0.3 | $7.1 \times 10^8$ |
| Comparative Example 18 | IP tube | 369.4 | 13.9 | 24 | 76 | 0 | 0 | $2.3 \times 10^7$ |
| Comparative Example 19 | IP tube | 377.4 | 12.7 | 5 | 9.5 | 0 | 0 | $2.3 \times 10^7$ |
| Comparative Example 20 | IP tube | 378.9 | 12.8 | 5 | 95 | 0 | 0 | $2.3 \times 10^7$ |

| | Undercoat layer | | Evaluations | | | |
|---|---|---|---|---|---|---|
| | Condition (B) Angular | | Evaluation of initial image quality | | Evaluation of image quality after output of 10,000 sheets | |
| | Frequency ωmax (Rad) | Thickness (μm) | Density of output image | Defective Image quality (white spots) | Density of output image | Defective Image quality (white spots) |
| Comparative Example 1 | 11.5 | 23.9 | Good | G4 | Good | G4 |
| Comparative Example 2 | 12.3 | 23.1 | Good | G4 | Good | G4 |
| Comparative Example 3 | 10.9 | 23.4 | Good | G4 | Good | G5 |
| Comparative Example 4 | 10.5 | 25.3 | Good | G5 | Good | G5 |
| Comparative Example 5 | 16.5 | 26.4 | Good | G4 | Good | G4 |
| Comparative Example 6 | 13.4 | 26.3 | Good | G4 | Good | G4 |
| Comparative Example 7 | 7.5 | 22.1 | Good | G5 | Good | G4 |
| Comparative Example 8 | 6.5 | 23.5 | Good | G5 | Good | G5 |
| Comparative Example 9 | 23.9 | 23.5 | Good | G4 | Good | G4 |
| Comparative Example 10 | 23.8 | 23.1 | Good | G4 | Good | G5 |
| Comparative Example 11 | 24.5 | 22.9 | Good | G4 | Good | G5 |
| Comparative Example 12 | 2.3 | 24.1 | Good | G0 | Bad | G0 |
| Comparative Example 13 | 2.2 | 23.5 | Good | G0 | Bad | G0 |
| Comparative Example 14 | 2.1 | 23.4 | Good | G0 | Bad | G0 |
| Comparative Example 15 | 1.9 | 23.3 | Good | G0 | Bad | G0 |
| Comparative Example 16 | 1.7 | 23.7 | Good | G0 | Bad | G0 |
| Comparative Example 17 | 1.1 | 23.6 | Good | G0 | Bad | G0 |
| Comparative Example 18 | 25.2 | 23.5 | Good | G4 | Good | G4 |
| Comparative Example 19 | 28.9 | 23.4 | Good | G4 | Good | G4 |
| Comparative Example 20 | 29.1 | 23.7 | Good | G4 | Good | G4 |

These result show Examples give better results than Comparative Examples in the evaluations of image quality.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate comprising depressions in a surface thereof that satisfies a condition (A);

an undercoat layer that satisfies conditions (B) and (C), that is disposed on the conductive substrate, and that contains metal oxide particles; and a photosensitive layer that is disposed on the undercoat layer, wherein the conditions (A) to (C) are as follows:

condition (A): in the case where the depressions existing in the surface of the conductive substrate are observed with a laser microscope, the width of the largest depression is 400 μm or less, and the depth of the depression is 15 μm or less;

condition (B): in the case where the undercoat layer is subjected to a Cole-Cole plot analysis, an angular frequency ωmax at which a complex impedance component is maximum is in the range of from 2.0 rad to 25.0 rad; and condition (C): volume resistivity obtained from the Cole-Cole plot analysis of the undercoat layer is in the range of from $7.0\times10^7\Omega$ to $1.0\times10^9\Omega$.

2. The electrophotographic photoreceptor according to claim 1, wherein the width of the largest depression is 380 μm or less.

3. The electrophotographic photoreceptor according to claim 1, wherein the width of the largest depression is 355 μm or less.

4. The electrophotographic photoreceptor according to claim 1, wherein the width of the largest depression is 12 μm or more.

5. The electrophotographic photoreceptor according to claim 1, wherein the depth of the largest depression is 14 μm or less.

6. The electrophotographic photoreceptor according to claim 1, wherein the depth of the largest depression is 12 μm or less.

7. The electrophotographic photoreceptor according to claim 1, wherein the depth of the largest depression is 3 μm or more.

8. The electrophotographic photoreceptor according to claim 1, wherein the angular frequency ωmax is in the range of from 2.0 rad to 15.0 rad.

9. The electrophotographic photoreceptor according to claim 1, wherein the angular frequency ωmax is in the range of from 2.0 rad to 14.0 rad.

10. The electrophotographic photoreceptor according to claim 1, wherein the volume resistivity is in the range of from $7.0\times10^{7}\Omega$ to $2.0\times10^{8}\Omega$.

11. The electrophotographic photoreceptor according to claim 1, wherein the volume resistivity is in the range of from $7.0\times10^{7}\Omega$ to $1.0\times10^{8}\Omega$.

12. The electrophotographic photoreceptor according to claim 1, wherein the undercoat layer contains a compound having an anthraquinone structure with a hydroxy group and represented by General Formula (1A)

General Formula (1A)

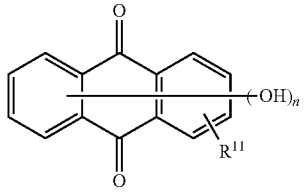

(where $R^{11}$ represents an alkoxy group having from 1 to 10 carbon atoms or a substituted or unsubstituted aryl group having from 6 to 30 carbon atoms, and n represents an integer from 1 to 8).

13. A process cartridge comprising the electrophotographic photoreceptor according to claim 1, wherein the process cartridge is removably attached to an image forming apparatus.

14. An image forming apparatus comprising:

the electrophotographic photoreceptor according to claim 1;

a charging unit that serves to charge the surface of the electrophotographic photoreceptor;

an electrostatic latent image forming unit that serves to form an electrostatic latent image on the surface of the charged electrophotographic photoreceptor;

a developing unit that serves to develop the electrostatic latent image on the surface of the electrophotographic photoreceptor with a developer containing toner to form a toner image; and a transfer unit that serves to transfer the toner image to the surface of a recording medium.

* * * * *